United States Patent [19]

Nishijima et al.

[11] Patent Number: 4,959,300

[45] Date of Patent: Sep. 25, 1990

[54] SILVER HALIDE PHOTOGRAPHIC LIGHT-SENSITIVE MATERIAL WITH IMPROVED GRADATION BALANCE

[75] Inventors: Toyoki Nishijima; Kaoru Onodera, both of Odawara, Japan

[73] Assignee: Konica Corporation, Tokyo, Japan

[21] Appl. No.: 180,478

[22] Filed: Apr. 12, 1988

[30] Foreign Application Priority Data

Apr. 15, 1987 [JP] Japan ..... 62-90676

[51] Int. Cl.[5] ..... G03C 1/38; G03C 7/38

[52] U.S. Cl. ..... 430/546; 430/558; 430/634; 430/635; 430/636

[58] Field of Search ..... 430/558, 546, 634, 635, 430/636

[56] References Cited

U.S. PATENT DOCUMENTS 2,992,108 7/1961 Knox et al. ..... 96/85

FOREIGN PATENT DOCUMENTS 199351 10/1986 European Pat. Off. .
2340178 2/1974 Fed. Rep. of Germany .
1205155 2/1960 France .
2006109 12/1969 France .

OTHER PUBLICATIONS

Patent Abstracts of Japan, vol. 2, No. 84 (E-42( 7/8/78, p. 3693 E 78 JPA 53-49427 (4/5/78).

Research Disclosure No. 160 8/77 pp. 28-30, Abstract #16040, Industrial Opportunities Ltd., Havant, Hampshire, GB.

Chemical Abstracts, vol. 102, (1985), p. 531, Abstract 70 121 p, JPA 59 37815 (9/12/84).

*Primary Examiner*—Paul R. Michl
*Assistant Examiner*—Lee C. Wright
*Attorney, Agent, or Firm*—Jordan B. Bierman

[57] ABSTRACT

A silver halide photographic light-sensitive material which is prevented from softening in gradiation of the toe proportion on the resultant characteristics curve during the storage of the material. The photographic material comprises a support having thereon at least one silver halide emulsion layer, and contains a magenta coupler represented by the following formula M-1 and at least one surface active agent having in the molecule thereof at least two groups selected from the group consisting of a carboxy group and salt thereof, a sulfonic group and a salt thereof and a salt of sulfric ester group.

Formula M-1 wherein Z represents a group of nonmetal atoms necessary for forming a nitrogen-containing heterocycle which may have a substituent group; X represents a hydrogen atom, or a group capable of being split off upon the reaction with the oxydized product of a color developing agent; and R represents a hydrogen atom or a substituent.

7 Claims, No Drawings

SILVER HALIDE PHOTOGRAPHIC LIGHT-SENSITIVE MATERIAL WITH IMPROVED GRADATION BALANCE

FIELD OF THE INVENTION

The present invention relates to a silver halide color photographic light-sensitive material, in particular, to a silver halide color photographic light-sensitive material excelling in preservility, color reproduction and preservability of image formed theron.

BACKGROUND OF THE INVENTION

It is conventionally well known in the art that an oxidation product of an aromatic primary amine color developing agent couples with a color coupler, when a silver halide color light-sensitive material is subjected to the imagewise exposing as well as color developing, and forms dyes such as an indophenol, indoaniline, indamine, azomethine, phenoxyazine, phenazine and dyes similar to them, thus finally forming a dye image.

Couplers for forming a yellow dye image are, for example, acylacetanilide couplers Couplers for forming a magenta dye are, for example, pyrazolone, pyrazolobenzimidazole, pyrazolotriazole, and indazolone couplers Commonly used cyan dye image forming couplers are, for example, phenol and naphthol couplers In particular, 1,2-pyrazolo-5-ones are commonly used as a coupler for forming a magenta dye image. Dyes formed from such couplers have a secondary absorption in the range around 430 nm in addition to a primary absorption around 550 nm; this secondary absorption in the blue spectral region causes color impurity which is a great disadvantage in color reproduction.

In addition, with the magenta coupler, a yellow stain due to light, heat and humidity in a non color formed portion is extremely greater than that of a cyan coupler or yellow coupler, incurring a disadvantage in improving image preservability.

Having satisfactorily improved secondary absorption making yellowish magenta color image as well as satisfactorily limited yellow stain, particularly excellent magenta couplers are pyrazolotriazoles described, for example, in U.S. Pat. No.s 3,725,067, Japanese Patent Publication Open to Public Inspection (hereinafter referred to as Japanese Pat. O.P.I. Publication) Nos. 99437/1984, 162548/1984, and 171956/1984, Research Disclosure Nos 24220, 24230 and 24531.

The dyes formed from the pyrazolotriazole magenta couplers, described in these patent specifications and literatures, have significantly limited secondary absorption in the range around 430 nm, when compared to the dyes formed from the previously mentioned, 1,2-pyrazolo-5-ones having an anilino group in the 3-position. Accordingly, in addition to the significantly limited yellow stain in a non dye formed area induced by light, heat or humidity, a pyrazolotriazole magenta coupler shows satisfactory characteristics including satisfactory color reproducibility.

The dyes formed from pyrazolotriazole magenta couplers have excellent characteristics mentioned above which are fully exhibited, particularly, when they are incorporated into photographic color papers.

However, when compared to 1,2-pyrazo-5-one magenta couplers having an anilino group in the 3-position, the pyrazolotriazole magenta couplers incorporated into a silver halide emulsion disadvantageously show greater change in gradation after a long term storage Various techniques for controlling gradation are known in the art. For example, as techniques for controlling gradation by controllingly preparing silver halide photographic light sensitive emulstions, teh rfollowing methods are known in teh art: a method for higher contrast performed by doping with metal such as rhodium as iridium ions during physical ripening; methods by controlling conditions for forming silver halide particles, such as the normal precipitation method for lower contrast, and the double-jet precipitation method for higher contrast; a method by deliverately selecting the pAg level, pH level, composition of silver halide particle in the course of particle formation; a method by changing condition for chemical sensitization. By using these methods independently or combinedly satisfactory gradation can be attained, however, most of these methods incur deterioration in other photographic properties such as sensitivity, fogging, reciprocity low failure, latent image stability, anti-pressure property, and production stability. Regardless of what method is used, it requires a great amount of effort to determine the conditions for satisfying all the criteria. Accordingly the commercial use of these techniques has limited effects.

To ensure color reproduction by color subtraction process, silver halide photographic light-sensitive materials such as a color photographic light-sensitive material for print incorporate a yellow coupler, magenta coupler and cyan coupler which are capable of forming, correspondingly, a yellow dye image, magenta dye image and cyan dye image by the coupling reaction with the oxidation product of an aromatic primary amine color developing agent Gradation modification may be achieved by deliverately selecting types of couplers and substituent groups contained in these couplers. However, such an arrangement also incurs change in other performance criteria such as tone of a dye image, and image preservability, making commercial use difficult.

An effective techniques to soften contrast in highlight portion by selecting a high boiling solvent for a coupler were described in Japanese Patent 0.P.I Publication No. 40550/1983. An effective technique for controlling gradation by selecting having a high boiling solvent for a coupler and by using a catecol derivative was described in Japanese Patent Application No. 213161/1984. However, these techniques are insufficient in preventing deterioration, in gradation balance indicated in the toe portion on the resultant characteristic curve, owing to the storage of the photographic material.

With the above mentioned pyrazolotriazone magenta coupler, as time elapses, gradation balance of silver chlorobromide green-sensitive emulsion layer containing the coupler is disturbed; more specifically, contrast at the toe portion on its characteristic curve softens, and each gradation balance at the toe portion on characteristic curve, respectively, of the red-scnsitive silver halide emulsion layer containing a cyan coupler, green-sensitive silver halide emulsion layer containing a magenta coupler, and blue-sensitive silver halide emulsion layer containing a yellow coupler is disturbed, often resulting in color print of unsatisfactory finish. Although slightly improving gradation balance, degree of improvement not yet satisfactory, an increased amount of a conventional surface active agent intensifies gradation deterioration attributable to the storage of photographic material and increases fogging. Accordingly, in order to ensure color print excelling in color reproduction and image preservability, it is essential to develop a technique for preventing softening in gradation at the toe portion on characteristic curve due to storage of photographic material, in particular, a technique for improving gradation balance indicated by the toe portion on the resultant characteristic curve, by utilizing property of the pyrazolotriazole magenta couplers mentioned above.

The present invention is based on the fact that a pyrazolotriazole magenta coupler or the like combined with a specific surface active agent provides color-balanced, sharp dye image free from gradation deterioration indicated by the poe portion on the resultant characteristic curve, where in the similar deterioration is attributable to storage of photographic material.

SUMMARY OF THE INVENTION

The first object of this invention is to provide a silver halide photographic light-sensitive material excelling in color reproduction, and image preservability, wherein the preservability of a stored material is improved The second object of this invention is to provide a silver halide color photographic light-sensitive material wherein among preservability criteria of a stored material, the softening in gradation indicated by the toe portion on the resultant characteristic curve, and color balance of the resultant image is well ensured.

These objects of the invention are achieved by a silver halide photographic light-sensitive material comprising a support, having thereon, at least one silver halide emulsion layer, wherein the silver halide photographic light-sensitive material contains a magenta coupler represented by general formula M-1 and at least one surface active agent having in the molecule thereof at least two groups selected from a carboxylic group and a salt thereof, a sulfonic group and a salt thereof, and a salt of sulfuric ester group.

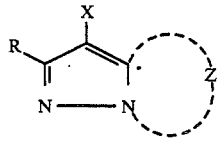

Formula [M-1]

Wherein Z represents a group of nonmetal atoms necessary for forming a nitrogen-containing heterocycle which may have a substituent group, X represents a hydrogen atom, or a group capable of being split off by the reaction with an oxidation product of a color developing agent, and R represents a hydrogen atom, or a substituent group.

DETAILED DESCRIPTION OF THE INVENTION

In the previously mentioned magenta coupler represented by Formula M-I;

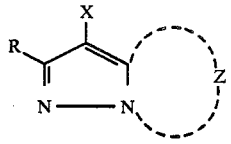

Formula [M-I]

Z represents a group of nonmetal atoms necessary for forming a nitrogen-heterocycle. The heterocycle formed by Z may have a substituent group.

X represents a hydrogen atom, or a group capable of splitting off by the reaction with an oxidation product of a color developing agent.

R represents a hydrogen atom, or a substituent group.

R represents an arbitrary substituent group; the typical examples of such a substituent group include an alkyl, aryl, anilino, acylamino, sulfonamide, alkylthio, arylthio, alkenyl, and cycloalkyl group. In addition, the examples further include a halogen atom, and cycloalkenyl, alkinyl, heterocycle, sulfonyl, sulfinyl, phosphonyl, acyl, carbamoyl, sulfamoyl, cyano, alkoxy, aryloxy, heterocycle-oxy, siloxy, acyloxy, carbamoyloxy, amino, alkylamino, imide, ureide, sulfamoylamino, alkoxycarbonylamino, aryloxycarbonylamino, alkoxycarbonyl, aryloxycarbonyl, and heterocyclic thio groups, as well as spiro compound residue, and bridged hydrocarbon compound residue.

The preferred alkyl group represented by R has 1 to 32 carbon atoms, and may be either straight-chained or branched.

The preferred aryl group represented by R is a phenyl group.

The examples of an acylamino group represented by R include an alkylcarbonylamino, and arylcarbonylamino groups.

The examples of a sulfonamide group represented by R include an alkylsulfonylamino, and arylsulfonylamino groups.

The examples of an alkyl component in alkylthio group represented by R, or aryl component in arylthio group represented by R include the alkyl and aryl groups expressed by R specified previously.

The examples of a preferred alkenyl group represented by R have 2 to 32 carbon atoms, and may be either straightchained or branched. The examples of a preferred cycloalkyl group represented by R have 3 to 12, or, preferably, 5 to 7 carbon atoms.

The examples of a preferred cycloalkenyl groups represented by R have 3 to 12 carbon atoms, preferably, 5 to 7.

The examples of a sulfonyl group represented by R include alkylsulfonyl and arylsulfonyl groups.

The examples of a sulfinyl group represented by R include alkylsulfinyl and arylsulfinyl groups.

The examples of a phosphonyl group represented by R include alkylphosphonyl, alkoxyphosphonyl, aryloxylphosphonyl, and arylphosphonyl groups.

The exmaples of an acyl group represented by R include alkylcarbonyl and arylcarbonyl groups.

The examples of a carbamoyl group represented by R include alkylcarbamoyl and arylcarbamoyl groups.

The examples of a sulfamoyl group represented by R include alkylsulfamoyl and arylsulfamoyl groups.

The examples of an acyloxy group represented by R include alkylcarbonyloxy and arylcarbonyloxy groups.

The examples of a carbamoyloxy group represented by R include alkylcarbamoyloxy and arylcarbamoyloxy groups.

The examples of a ureide group represented by R include alkylureide and arylureide groups.

The examples of a sulfamoylamino group represented by R include alkylsulfamoylamino and arylsulfamoylamino groups.

The preferred examples of a heterocycle group represented by R are five- to seven-membered groups, and typified by 2-furyl, 2-thienyl, 2-pyrimidinyl, 2-benzothiazolyl groups.

The preferred examples of a heterocycle-oxy group represented by R are five- to seven-membered groups, and typified by 3,4,5,6-tetrahydropyranyl-2-oxy, and 1-phenyltetraazole-5oxy groups.

The preferred examples of a heterocycle-thio group represented by R are five- to seven-membered groups, and typified by 2-pyridylthio, 2-benzothiazolylthio, 2,4-diphenoxy1,3,5-triazole-6-thio groups.

The examples of a siloxy group represented by R include trimethylsiloxy, triethylsiloxy, and dibutylsiloxy groups.

The examples of an imide group represented by R include succinimide, 3-heptadecyl succinic imide, phtalimide, and glutarimide groups.

The examples of a spiro compound residue represented by R include spiro[3.3]heptane-1-yl.

The examples of a bridged hydrocarbon residue represented by R include bicyclo[2.2.1]heptane-1-yl, tricyclo [3.3.1.1$^{3,7}$]decane-1-yl, and 7,7-dimethyl-bicyclo[2.1.1]heptane-1-yl.

The examples of a group represented by X and capable of being split off by the reaction with an oxidation product of a color developing agent include a halogen atom such as chlorine, bromine, and fluorine, and alkoxy, aryloxy, hetero-cycle-oxy, acyloxy, sulfonyloxy, alkoxycarbonyloxy, aryloxycarbonyl, alkyloxalyloxy, alkoxyoxalyloxy, alkylthio, arylthio, heterocycle-thio, alkyloxythiocarbonylthio, acylamino, sulfonamide, nitrogen-containing heterocyclic ring bonded through a nitrogen atom, alkyloxycarbonylamino, aryloxycarbonylamino, and carboxyl groups, and;

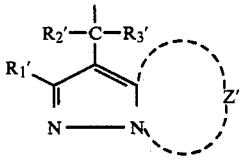

wherein $R_1'$ is synonymous with the previously defined R; Z' is synonymous with the previously defined Z; $R_2'$ and $R_3'$ independently represent a hydrogen atom, or aryl, alkyl, or heterocycle group. The preferred example of such a group represented by X is a halogen atom, in particular, a chlorine atom.

The examples of a nitrogen-heterocycle formed by Z or Z' include pyrazole, imidazole, triazole and tetrazole rings. The ring may possess a substituent represented by the previously defined R.

The compounds represented by general formula M-I are more specifically expressed by the following Formulas M-II through M-VII.

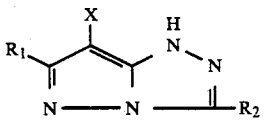

Formula M-II

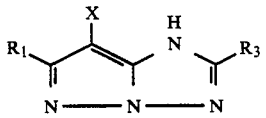

Formula M-III

-continued

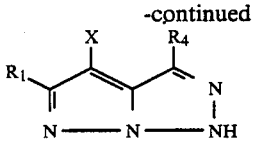

Formula M-IV

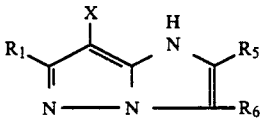

Formula M-V

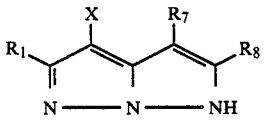

Formula M-VI

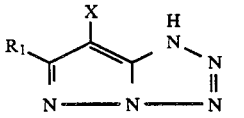

Formula M-VII

With formulas M-II through M-VII, above, each of $R_1$ through $R_8$ is synonymous with the previously defined R; and X, teh previously defined X.

Among compounds expressed by general formula M-I, those expressed by teh following formula M-VIII are most advantageous.

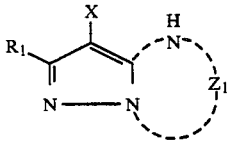

Formula M-VIII

Wherein $R_1$, X, and $Z_1$ are respectively synonymous with R, X, and Z in formula M-I.

Among magenta couplers expressed by formulas M-II through M-VII, above, the most advantageous magenta couplers are those expressed by formula M-IX.

The most favorable R or $R_1$, which is a substituent group on the previously mentioned heterocycle, is the group expressed by following formula M-IX.

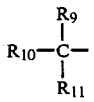

Formula M-IX

Wherein $R_9$, $R_{10}$, and $R_{11}$ are synonymous with the previously mentioned R.

Additionally, two among the previously defined $R_9$, $R_{10}$, and $R_{11}$, for example, $R_9$ and $R_{10}$, may mutually combine to form a saturated or unsaturated ring such as cycloalkane, cycloalkene, and heterocycle, wherein R'' may combine with this ring to form a residue of bridged hydrocarbon compound.

Among compounds expressed by formula M-IX, those most advantageous are defined as follows:

(i) compounds, in which at least two of $R_9$ through $R_{11}$ are alkyl groups;

(ii) compounds, in which one of $R_9$ through $R_{11}$, for example $R_{11}$, is a hydrogen atom, and remaining two, for example $R_9$ and $R_{10}$, are bonded together thereby forming, together with a bridgehead atom, a cycloalkyl compound.

More specifically, the particularly advantageous compounds among those categorized as (i) are compounds, in which two of $R_9$ through $R_{11}$ are alkyl groups and remaining one is an alkyl group or hydrogen atom.

Additionally, the preferable example of a substituent which the ring formed by Z in formula M-I may have, or a substituent which the ring formed by $Z_1$ in the formula M-IV may have, as well as the examples of $R_2$ through $R_8$ in formulas M-II through M-VI, are preferably those expressed by following formula M-X.

$$-R^1-SO_2-R^2 \qquad \text{Formula M-X}$$

Wherein $R^1$ represents an alkylene group; $R^2$ represents an alkyl, cycloalkyl, or aryl group.

The examples of a preferred alkylene group represented by $R^1$ have, on a straight chain, more than 2 carbon atoms, or, preferably more than 3 and less than 7, and may be either straight-chained or branched.

The preferred examples of a cycloalkyl group represented by $R^2$ are five- or six-membered groups.

The typical examples of the compounds according to the present invention are listed below.

Magenta couplers

1

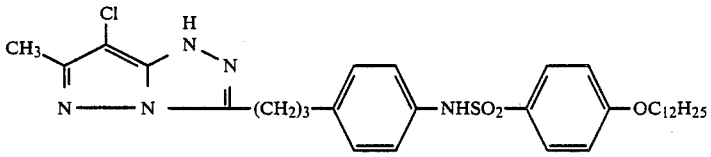

2

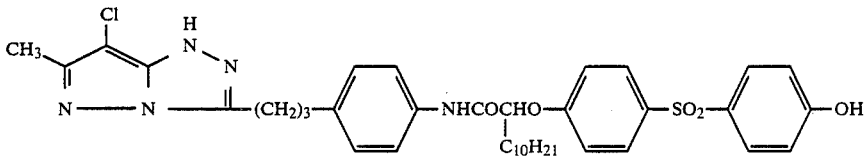

3

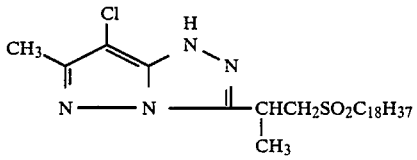

4

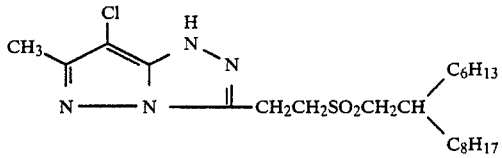

5

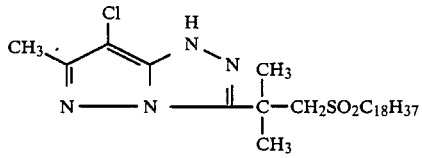

6

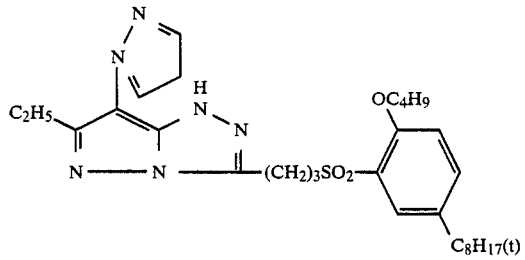

7

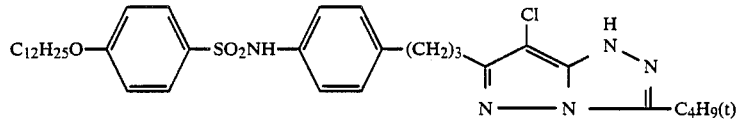

-continued
Magenta couplers
8
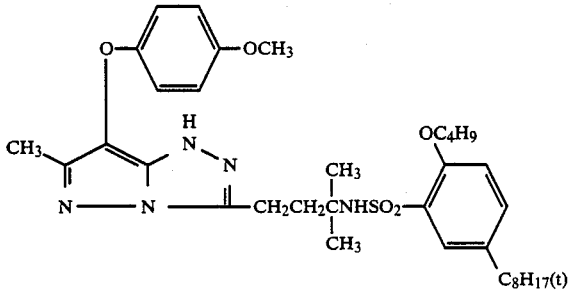
9
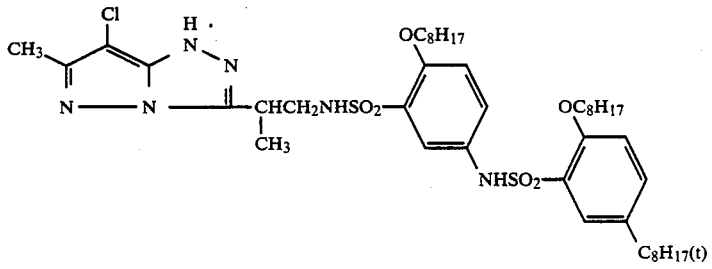
10
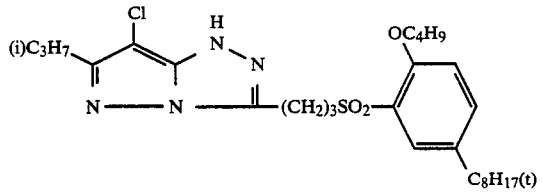
11
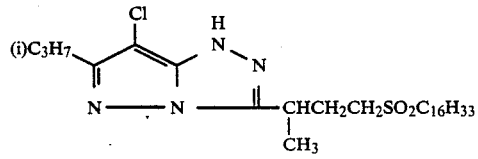
12
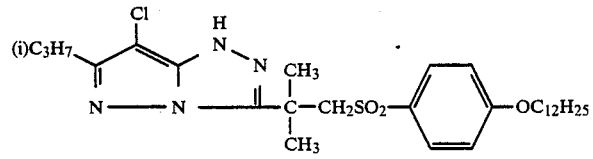
13
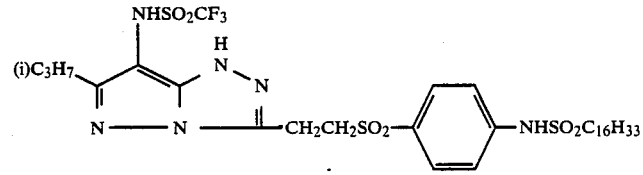
14
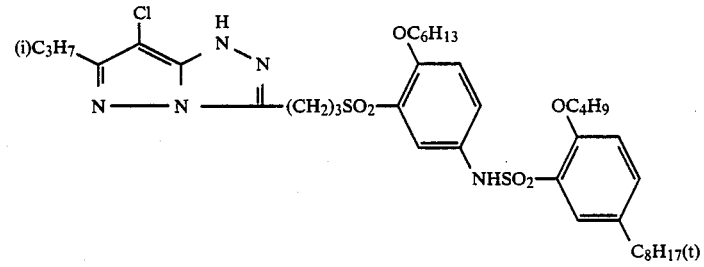

-continued
Magenta couplers
15
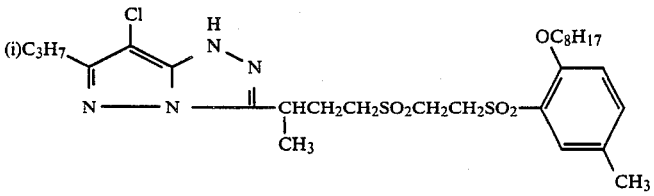
16
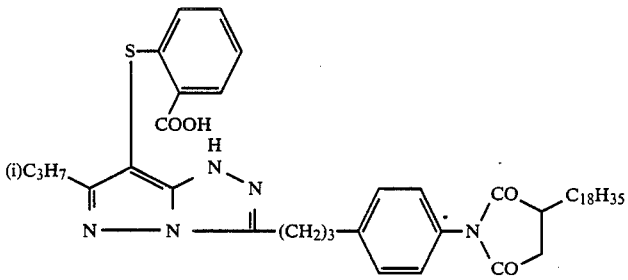
17
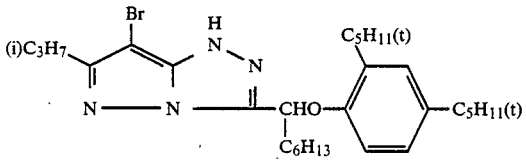
18
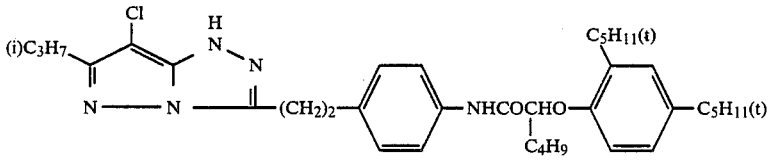
19
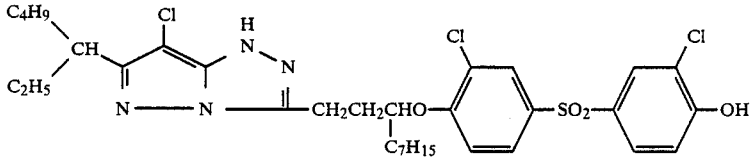
20
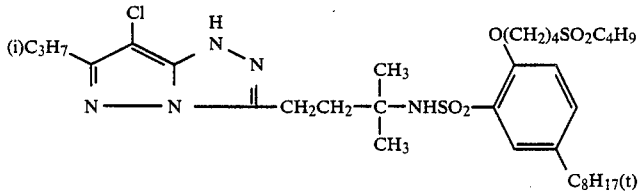
21
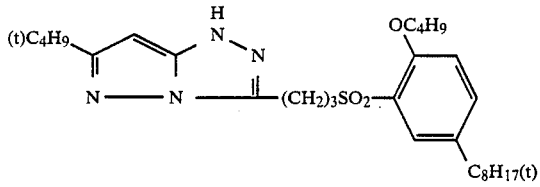
22
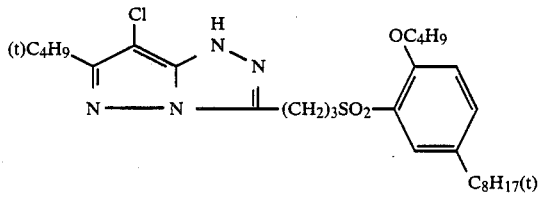

-continued
Magenta couplers
23
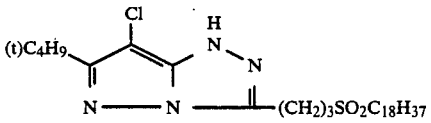
24
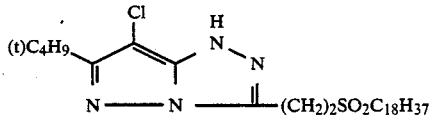
25
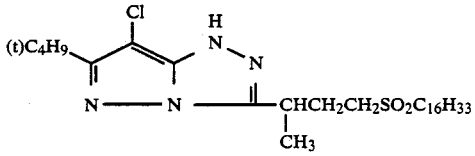
26
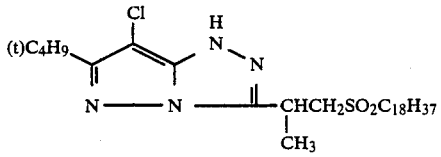
27
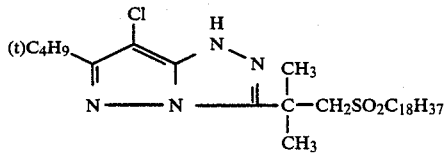
28
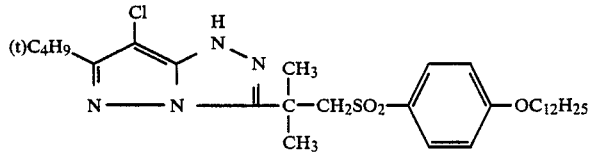
29
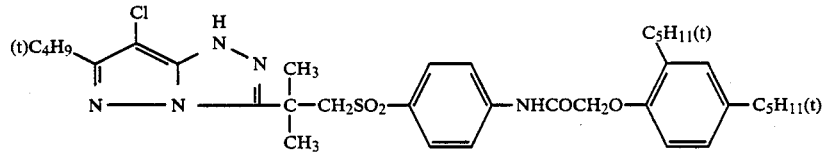
30
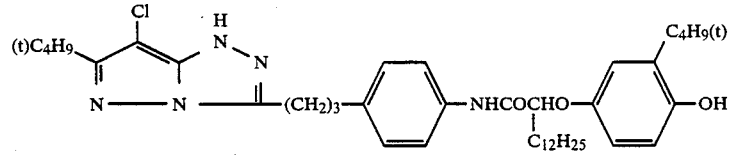
31
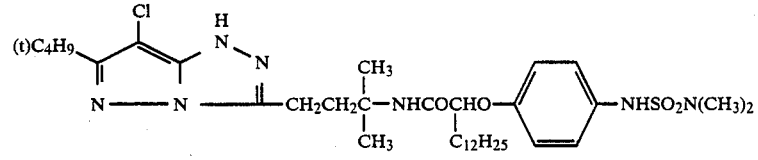

-continued
Magenta couplers
32
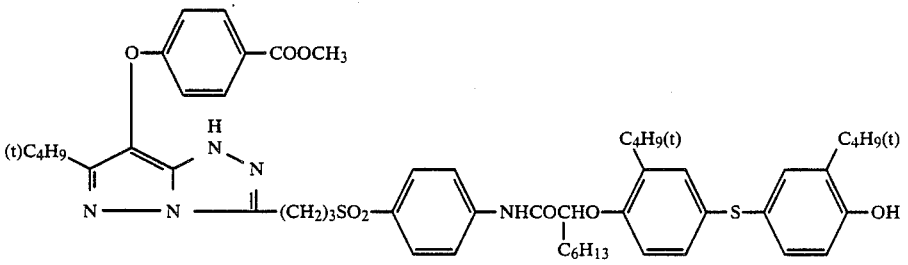
33
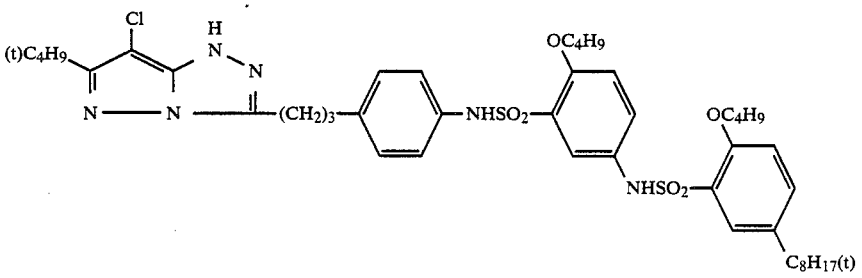
34
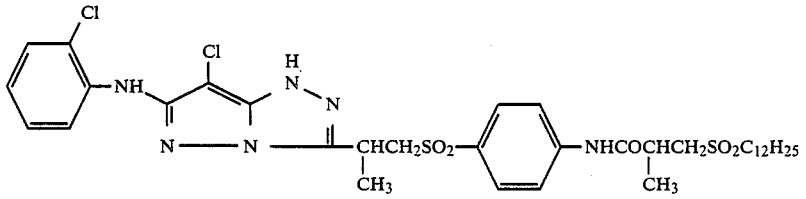
35
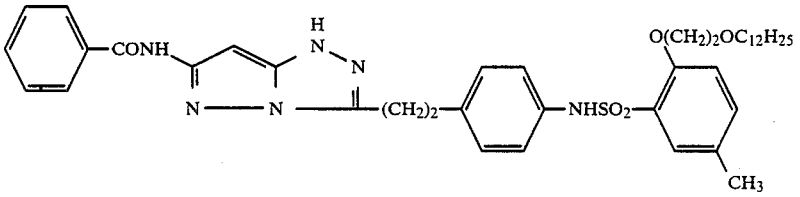
36
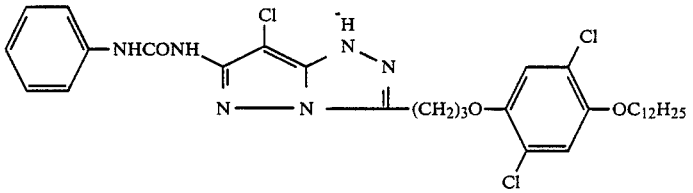
37
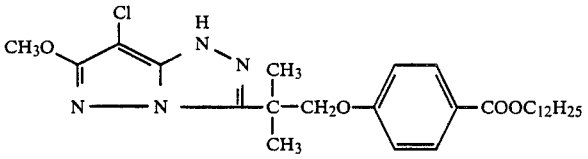

-continued
Magenta couplers
38
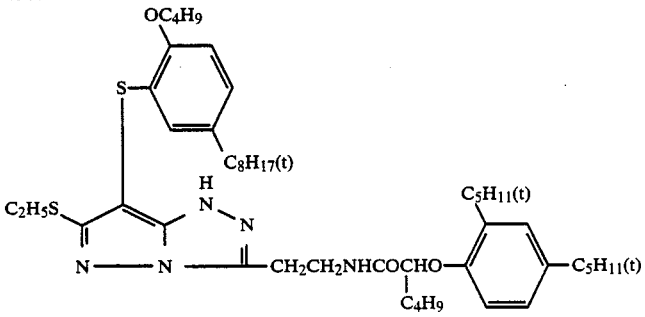
39
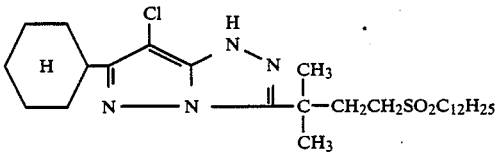
40
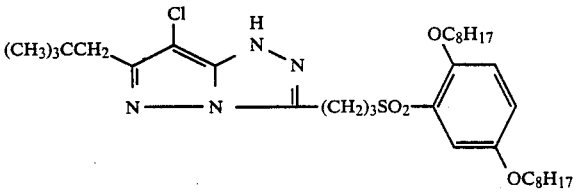
41
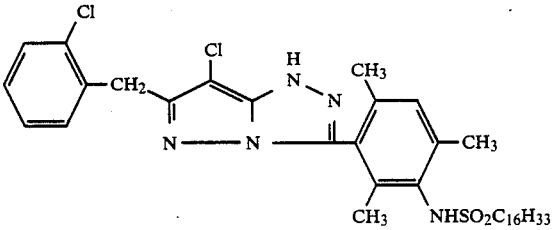
42
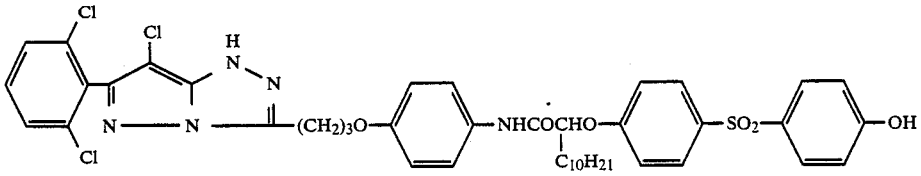
43
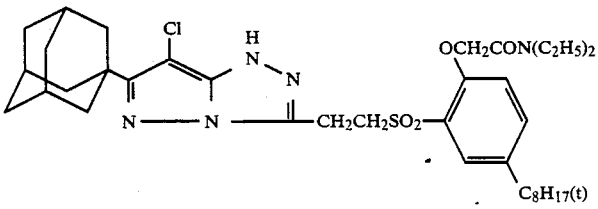
44
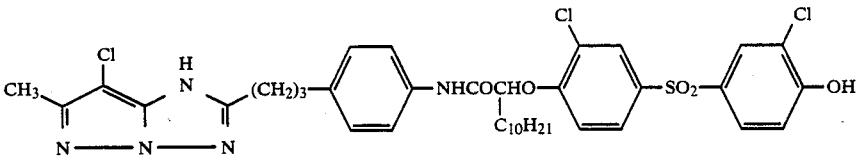
45
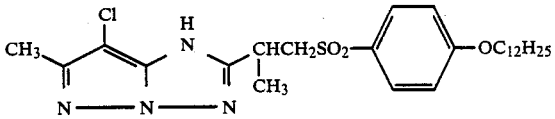

-continued
Magenta couplers
46
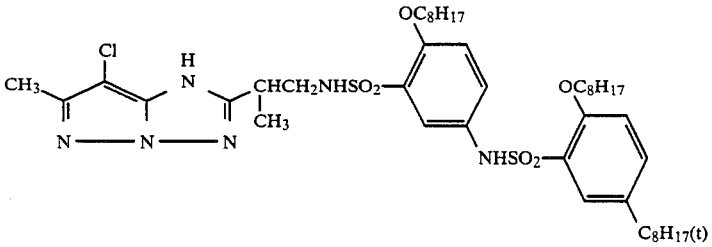
47
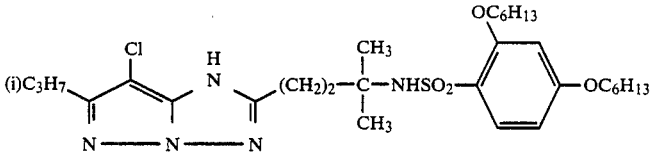
48
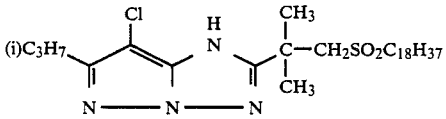
49
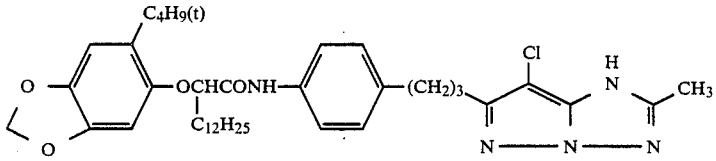
50
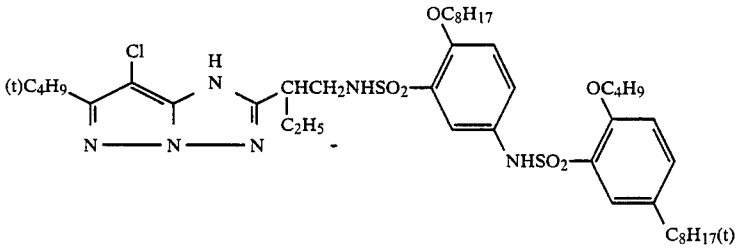
51
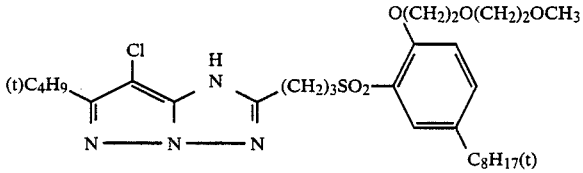
52
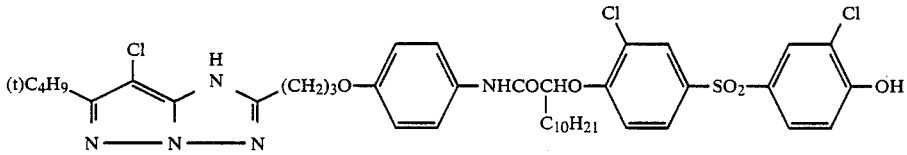
53
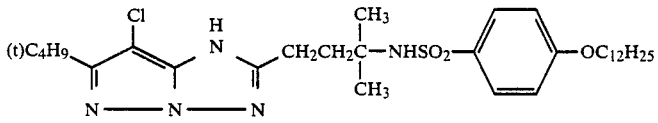
54
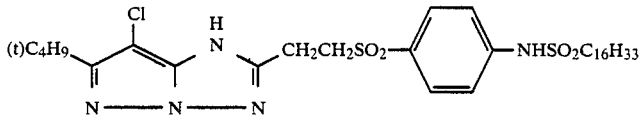

-continued

Magenta couplers

55

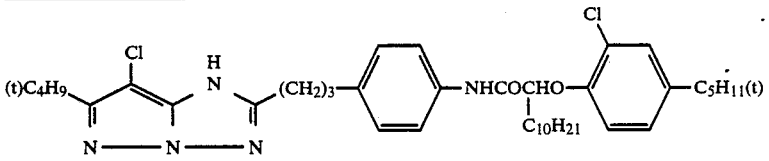

56

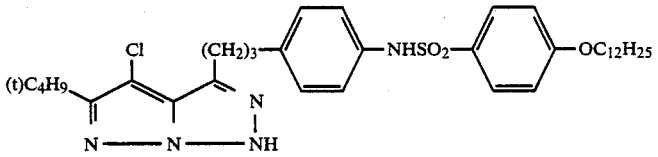

57

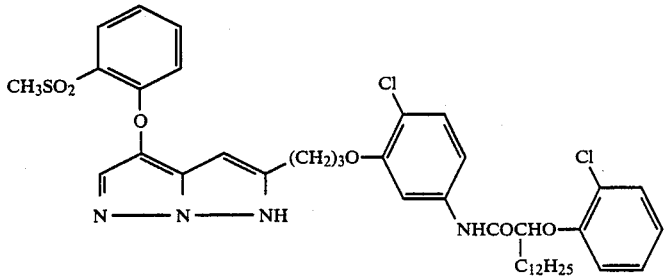

58

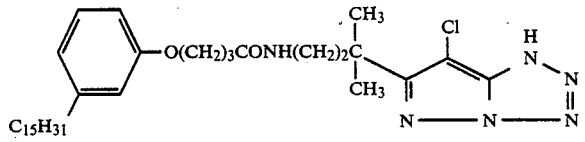

59

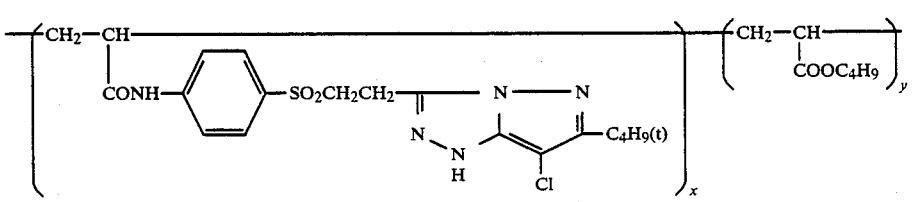

x:y = 50:50

60

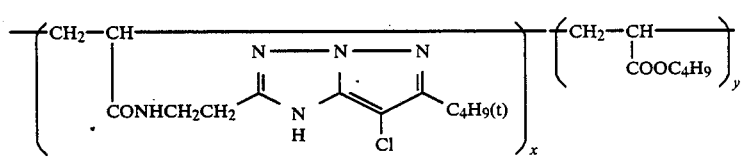

x:y = 50:50

M-61

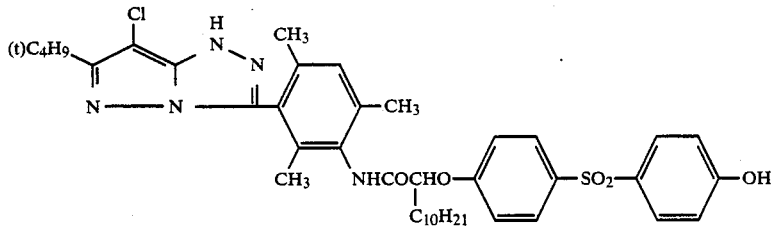

Other than these typical compounds of the invention, typical examples of compounds which can be advantageously used in the invention are Nos. 1 through 4, 6, 8 through 17, 19 through 24, 26 through 43, 45 through 59, 61 through 104, 106 through 121, 123 through 162, 164 through 223, among those compounds described on page 66 to 122 in the specification of the Japanese patent application No. 7791/1981.

Additionally, these couplers listed above can be synthesized by referring to the descriptions in, for example, Journal of the Chemical Society, Perkin I, (1977), pp. 2047 through 2052; U.S. Patent No. 3,725,067; Japanese Patent 0.P.I Publication Nos. 99437/1984, 42045/1983, 162548/1984; 171956/1984, 33552/1985, 43659/1985, 172982/1985, and 190779/ 1985.

The couplers of the present invention may be principally employed at a rate of $1\times10^{-3}$ to 1 mol, preferably, $1\times19^{-2}$ to $8\times10^{-1}$ mol per mol silver halide.

Additionally, the couplers of the present invention may be employed in combination with other types of magenta couplers.

The examples of yellow and cyan couplers which are employable in a silver halide photographic light-sensitive material of the present invention are as follows.

Y-1

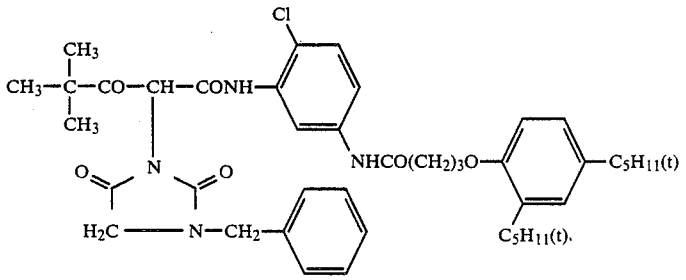

Y-2

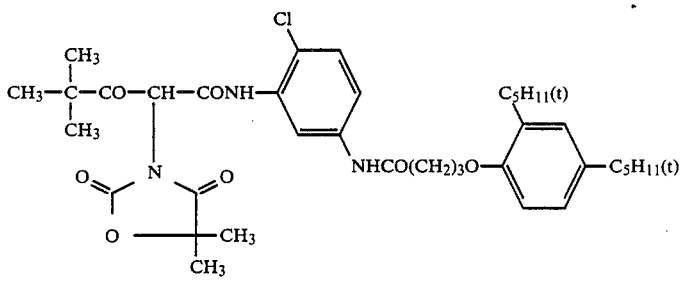

Y-3

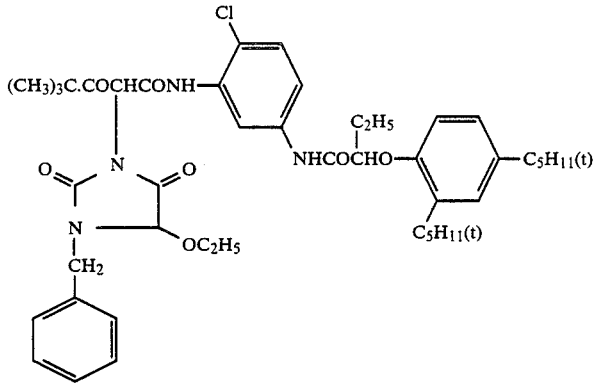

Y-4

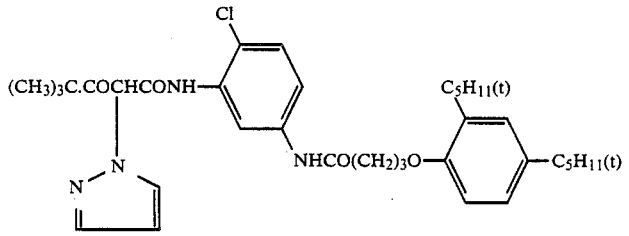

-continued
Y-5
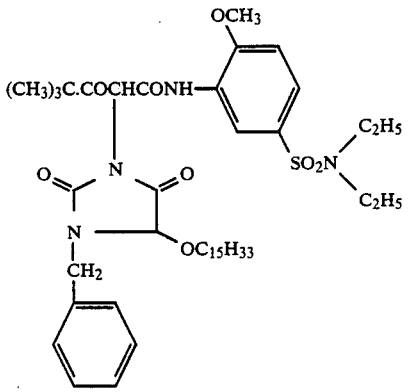
Y-6
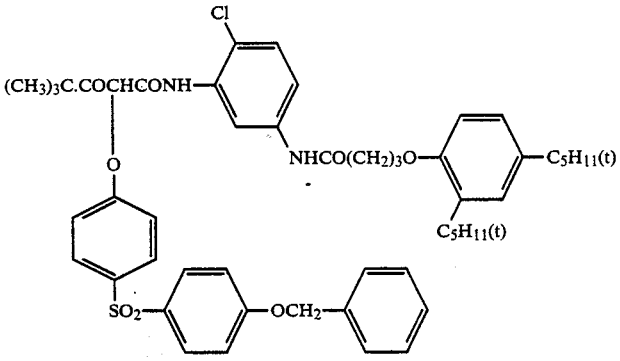
Y-7
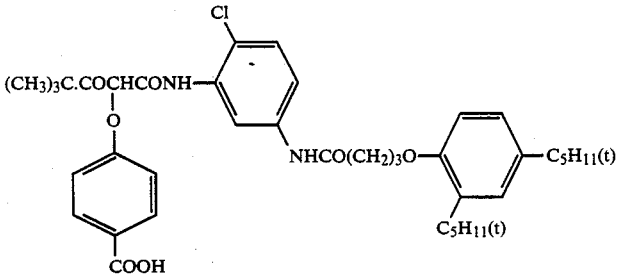
Y-8
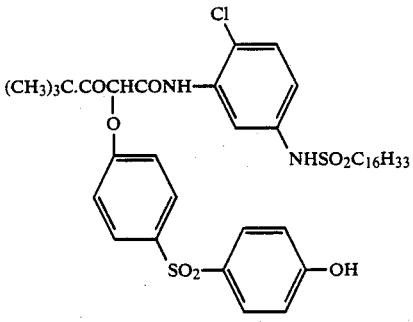

-continued
Y-9
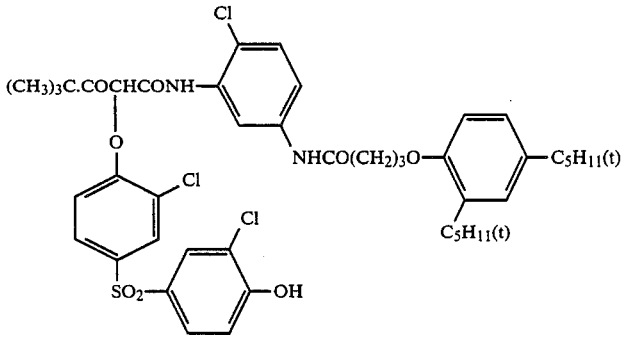
Y-10
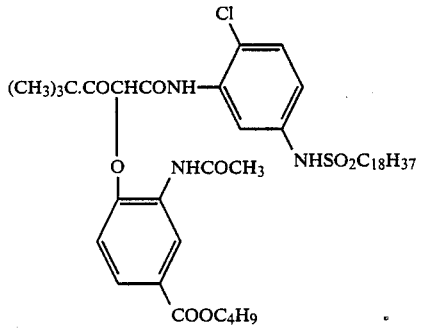
Y-11
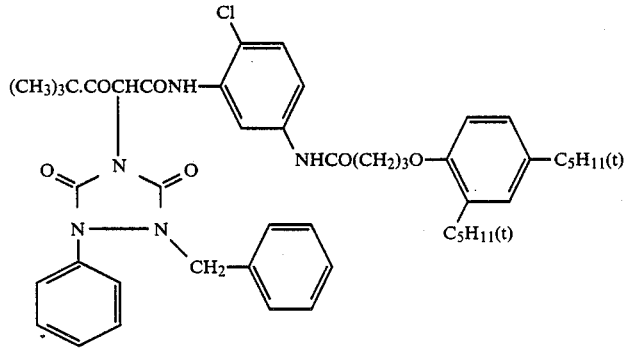
Y-12
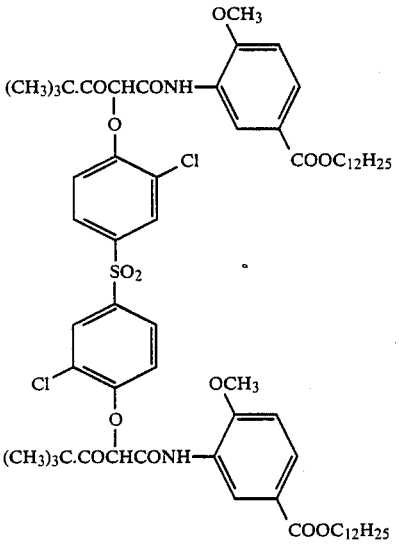

-continued
Y-13
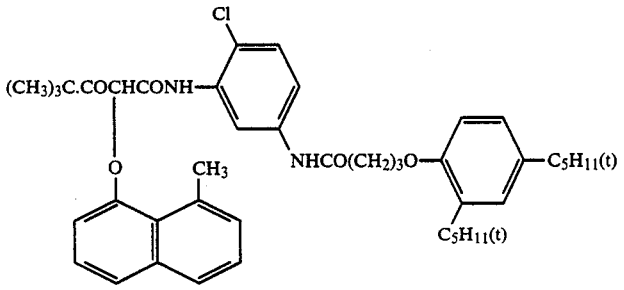
Y-14
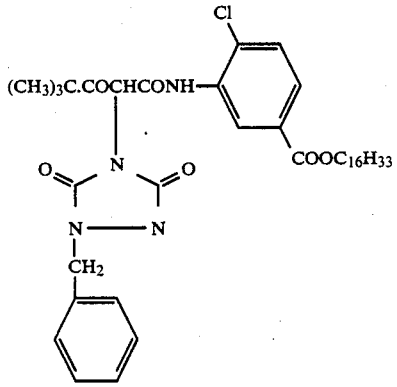
Y-15
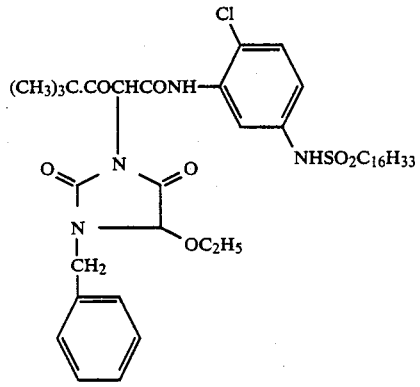
These yellow coplers are described in, for example, West German OLS Pat. Nos. 2,057,941, and 2,163,812; Japanese Pat. O.P.I. Publication Nos. 26133/1972, 29432/ 1973, 65231/1975, 3631/1976, 50734/1976, 102636/1976, 33410/ 1976, 66835/1973, 94432/1973, 1229/1974, and 10736/1974; Japanese Pat. Examined Publication No. 25733/1977.
Cyan coupler
C-1
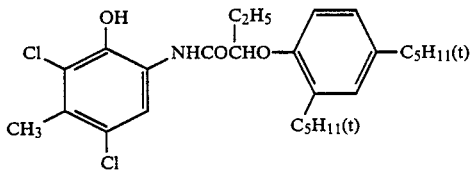
C-2
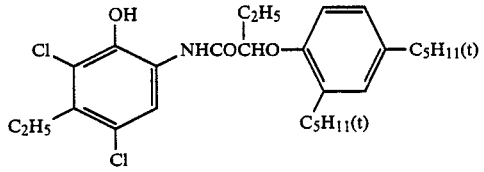

-continued
Cyan coupler
C-3
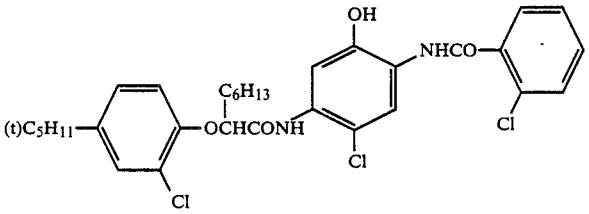
C-4
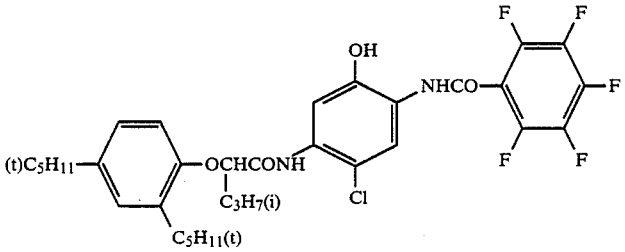
C-5
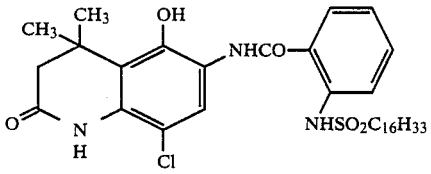
C-6
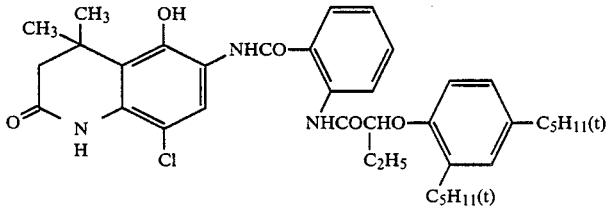
C-7
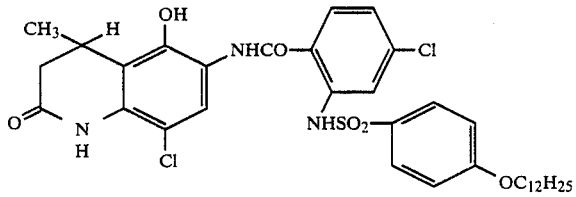
C-8
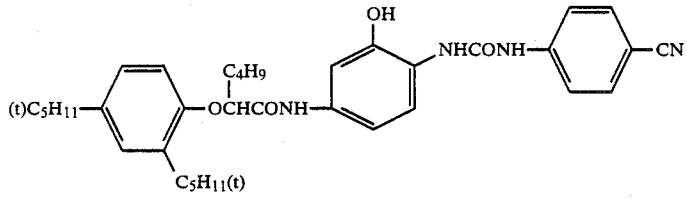

-continued

Cyan coupler

C-9

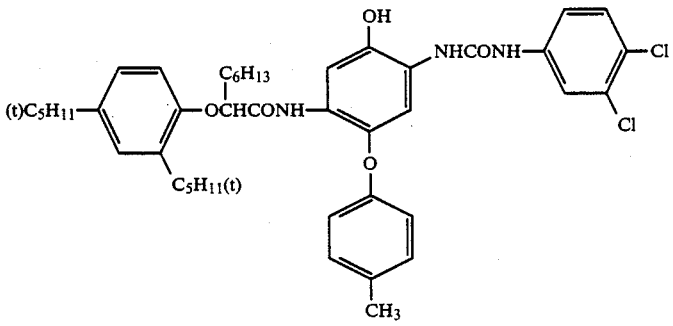

C-10

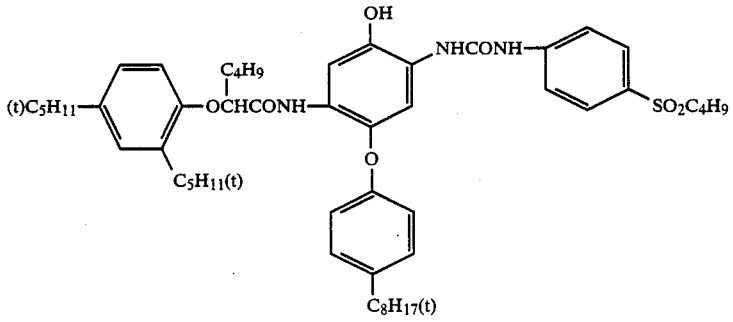

In addition to these compounds, the typical examples of cyan dye forming coupler include tetravalent or divalent cyan dye forming couplers of phenol or naphthol compounds. Such couplers are described in the following patents: U.S. Pat. Nos. 2,306,410, 2,356,475, 2,362,598, 2,367,531, 2,369,919, 2,423,730, 2,474,293, 2,476,008, 2,498,466, 2,545,687, 2,728,660, 2,772,162, 2,895,826, 2,976,146, 3,002,836, 3,419,390, 3,446,623, 3,476,563, 3,737,316, 3,758,308, and 3,839,044; British Pat. Nos. 478,991, 945,542, 1,084,480, 1,377,233, 1,388,024, and 1,543,040; and Japanese Patent O.P.I Publication Nos. 37425/1972, 10135/1975, 25228/1975, 112038/1975, 117422/1975, 130441/1975, 6551/1976, 37647/1976, 52828/1976, 108841/1976, 109630/1978, 48237/1979, 66129/1979, 131931/1979, and 32071/1980.

Each coupler of the above mentioned is usually employed at a rate of $1\times10^{-3}$ to 1 mol, or, preferably, $1\times10^{-2}$ to $8\times10^{-1}$ mol per mol silver halide.

The following formulas I, II, and III independently express surface active agents useful in embodying the present invention.

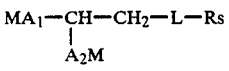

Formula I

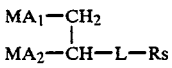

Formula II

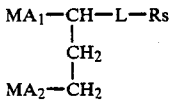

Formula III wherein Rs represents a substituent, and L represents —COO—, or —CONH—. $A_1$ and $A_2$ respectively represent $—COO^{63}$ group, and $—SO_3^{\ominus}$and/or $—OSO_3^{\ominus}$ gropu. M represents a hydrogen atom or a cation.

The present invention is hereinunder described in more detail.

In the surface active agents which are employed in the present invention and are expressed by the formula I, II, and III, Rs represents an arbitrary substituent group; the typical examples of such a substituent group include an alkyl, aryl, alkenyl, and cycloalkyl group.

The preferred alkyl group represented by Rs has 6 to 32 carbon atoms, and may be either straight-chained or branched.

The preferred aryl group represented by Rs is a phenyl group which may possess a substituent such as an alkyl group.

The preferred example of an alkenyl group expressed by Rs have to 6 to 32 carbons. The preferred cycloalkyl group is cyclohexyl group. These two groups may have a substituent such as an alkyl group.

The synthesizing methods for these compounds are well known in the art, thereby those compounds can be easily synthesized by those versed in the art. For example, these compounds are synthesized by subjecting maleic or fumaric acid to sulfonation after subjecting one molecule of carboxylic acid to amidation or esterification with an alkyl amine or alkyl alcohol.

Additionally, the preferred surface active agents employable in the present invention and expressed by formulas I, II, or III are, in particu lar, those expressed by formulas I', II', II'' and III'.

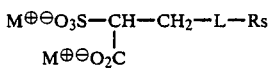

Formula I'

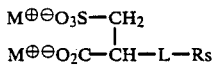

Formula II'

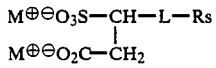

Formula II''

-continued

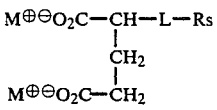

Formula III' wherein M, L, and Rs are synonymous with the previously mentioned M, L and Rs in formulas I, II and III.

More specifically, the surface active agent expressed by general formula I', II' or II'' is more advantageous.

The surface active agent employed in the present invention is used at a rate of 0.001 g to 0.1 g, or, preferably, 0.01 g to 0.05 g per gram of the magenta coupler mentioned above.

Additionally, the typical example of compounds used as a surface active agent accordign to the invention are as follows However, the scope of the invention is not limited only to these examples.

Surface active agents

1 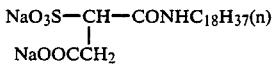

2 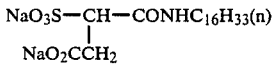

3 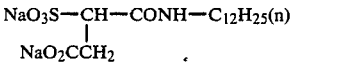

4 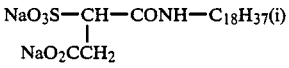

5 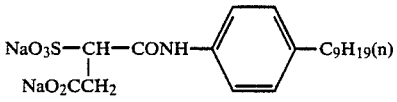

6 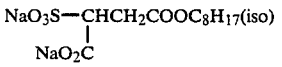

7 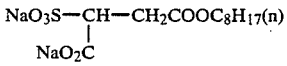

8 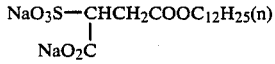

9 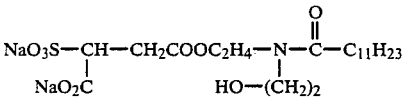

10 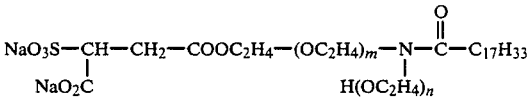

m + n = 6

11 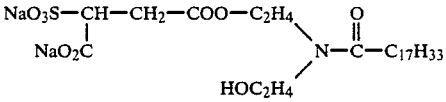

12 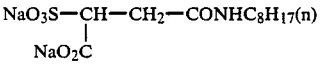

-continued

Surface active agents

13 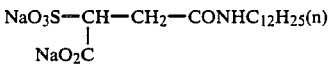

14 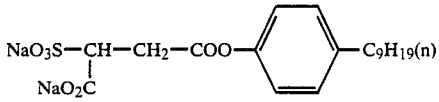

15 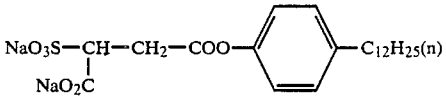

16 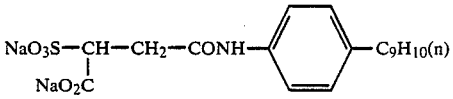

17 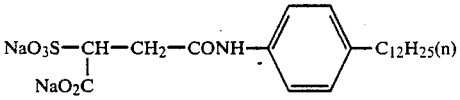

18 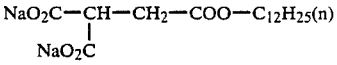

19 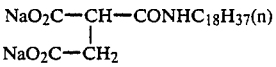

20 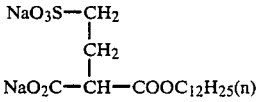

21 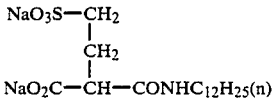

22 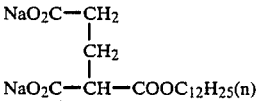

23 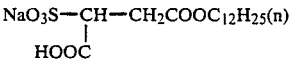

24 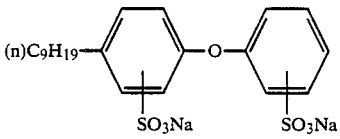

25 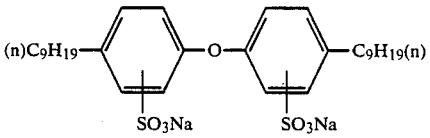

-continued

Surface active agents

26

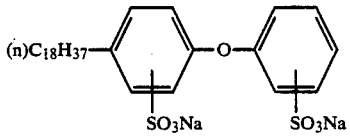

27

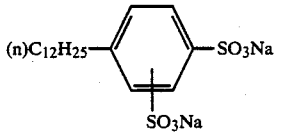

28

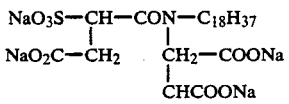

29

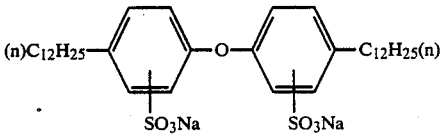

30

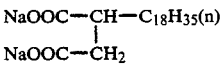

31

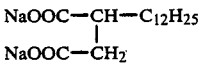

The surface active agents of the present invention may be used singly or in combination with another surface active agent described below. The preferred surface active agents are as follows.

The typical preferred examples of useful compounds for photographic application are as follows.

The surface active agent employed in the present invention may be used in combination with a so-called anionic surface active agent and/or non-ionic surface active agent.

The preferred examples of the anionic surface active agent are compounds having both a hydrophobic group having 8 to 30 carbon atoms, and a —$SO_3M$ group or —$OSO_3M$ group wherein M is synonymous with the previously defined M in I. Such compounds are described in "the Synthesis and Application of Surface Active Agents" (Maki Shoten) by Kohei Ohara and Kazuhiro Shimura, and "Surface Active Agents" (Interscience Publications Inc. New York) by A.W. Perry.

The useful examples of the non-ionic surface active agent include the non-ionic surface active agents and fatty acid esters of polyhydric alcohols described in Japanese Patent 0.P.I Publication No. 30933/1973. The preferred examples of the fatty acid ester of polyhydric alcohol have at least 2, preferably 3, hydroxyl groups and have fatty acid residue with 6 to 25 carbon atoms. Typically, a non-ionic surface active agent of a fatty acid ester of sorbitan described in U.S. Pat. No. 3,676,141 is used advantageously in the present invention.

The typical examples of the anionic surface active agent are as follows:

$C_{12}H_{25}OSO_3Na$ (A-1)

-continued $C_{14}H_{29}OSO_3Na$ (A-2)

Turkey red oil (A-3)

$C_{12}H_{25}CONHCH_2CH_2OSO_3Na$ (A-4)

$C_{12}H_{25}SO_3Na$ (A-5)

$C_{14}H_{29}SO_3Na$ (A-6)

(A-7)

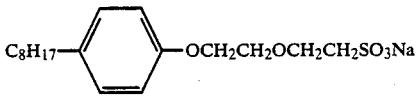

(A-8)

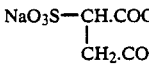

(A-9)

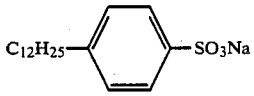

(A-10)

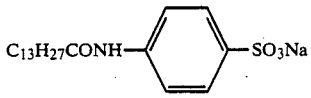

(A-11)

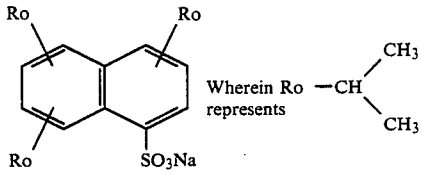

In the present invention, it is especially advantageous to combinedly use at least one surface active agent according to the invention with at least one anionic surface active agent which has both a hydrophobic group having 8 to 30 carbon atoms and a —$SO_3M$ group or —$OSO_3M$ group, wherein M is synonymous with previously described M in formula I, and/or at least one non-ionic surface active agent comprising fatty acid ester of sorbitan.

Additionally, in the silver halide photographic light-sensitive material of the invention, it is advantageous to incorporate an antioxidant comprising a phenol expressed by the following formula IV into a silver halide emulsion layer containing a magenta coupler.

Formula IV

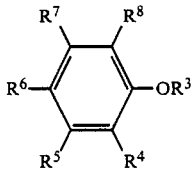

wherein $R^3$ represents a hydrogen atom, alkyl, alkenyl, aryl, or heterocycle group; $R^4R^5$, $R^7$ and $R^8$ independently represent a hydrogen atom, hydroxy, alkyl, alkenyl, aryl, alkoxy, or acylamino group. $R^6$ represents an alkyl, hydroxy, aryl or alkoxy group. $R^3$ and $R^4$ may be bonded together to form a five- or six-membered ring. In that case, $R^6$ represents a hydroxy or alkoxy group. $R^3$ and $R^4$ may be bonded together to form a methylenedioxy ring. Additionally, $R^5$ and $R^6$ may be bonded together to form a five-membered hydrocarbon ring. In that case, $R^3$ represents an alkyl, aryl, or heterocycle group. This description does not apply when $R^3$ is a hydrogen atom and $R^6$ is a hydroxy group.
The typical examples of a compound expressed by formula IV and advantageously used in the present invention are as follows.
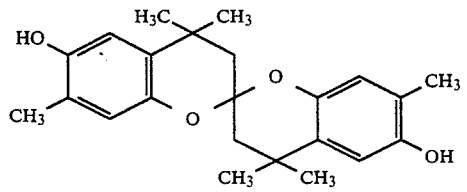
PH-1
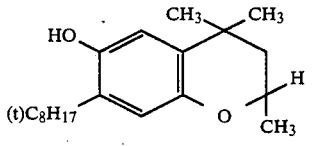
PH-2
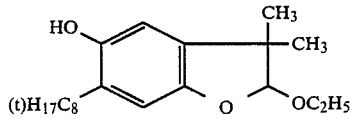
PH-3
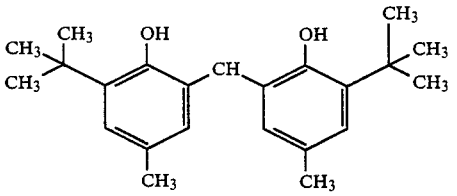
PH-4
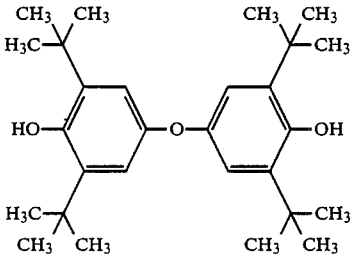
PH-5
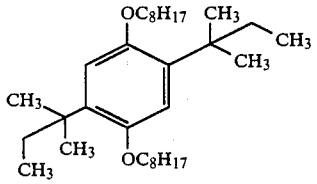
PH-6
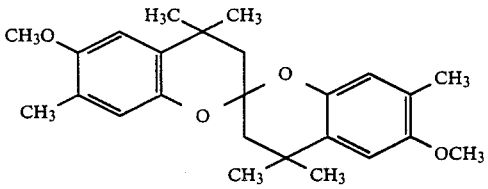
PH-7
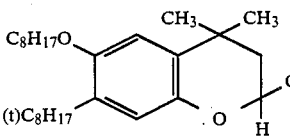
PH-8
-continued
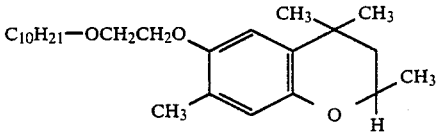
PH-9
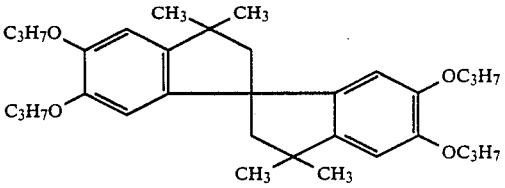
PH-10
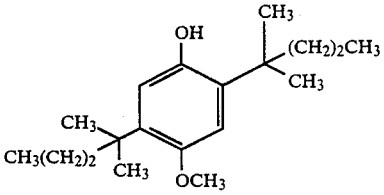
PH-11
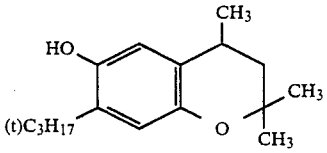
PH-12
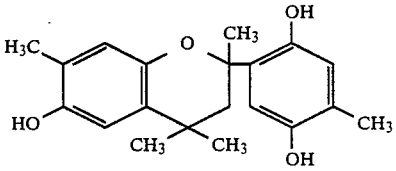
PH-13
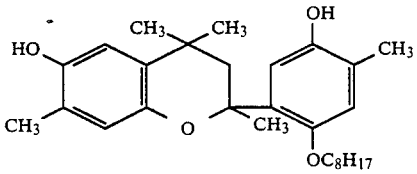
PH-14
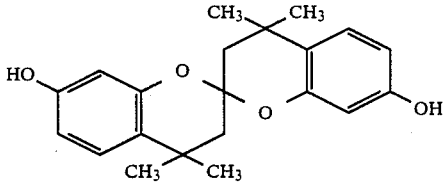
PH-15
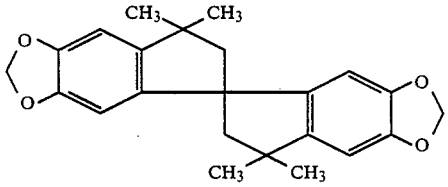
PH-16
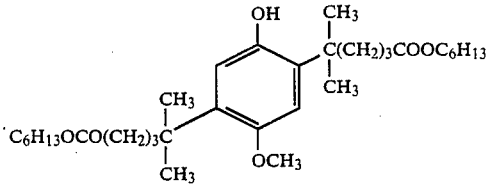
PH-17

-continued

PH-18

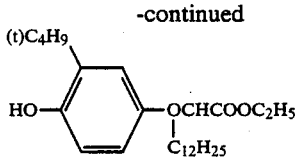

PH-19

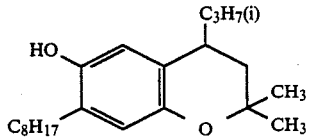

PH-20

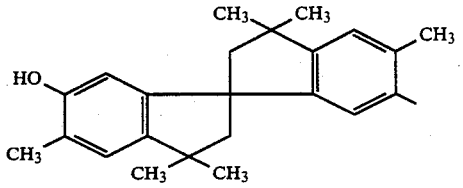

These phenols or phenyletehrs expressed by formula IV are used preferably at a rate of $1\times10^{-2}$ to 5 mol, in particular, $1\times10^{-1}$ to 2 mol per mol magenta coupler.

Not mention to the black and white silver halide photogenic light-sensitive material, the silver halide photographic light-sensitive materials of the invention, for example, those for color negative or positive films, and for color photographic papers can be whichever monochromatic or multicolor materials. In principal, a multi-color silver halide photographic light-sensitive material has, in order to enable subtractive color reproduction, a constitution wherein silver halide emulsion layers containing magenta, yellow and cyan couplers, serving as photographic couplers, as well as nonlight sensitive layers are coated on a support in an adequate number and order. However, the number and order may be arbitrarily modified in compliance with the important performance and utilization purpose.

For the silver halide emulsions, which are incorporated into the silver halide photographic light-sensitive materials of the invention, any of the silver halides, incorporated into ordinary silver halide emulsion such as silver bromide, silver iodo-bromide, silver iodo-chloride, silver chlorobromide, silver chloride and the like, may be arbitrarily employed.

The silver halide grains employed in the silver halide emulsions may be obtained through whichever an acid process, neutral process or ammonium process. The grains may be allowed to grow at once or may be allowed to grow after forming seed grains. The methods to form seed grains and to grow grains may be whichever same or different.

In preparing a silver halide emulsion, both halide ions and silver ions may be simultaneously added into an emulsion, or halide ions may be added into an emulsion containing only silver ions, and vice versa. Additionally, considering the critical growth rate of a silver halide crystals, the halide ions and the silver ions may be added into a mixing vessel whichever consecutively or simultaneously while controlling the pH and pAg levels within the vessel, so as to generate the silver halide crystals. After the crystals have grown up, the silver halide constitution within the grains may be transformed by means of a conversion process.

During the course of the production of the silver halide emulsion of the invention, the size, configuration, size distribution and growth of silver halide grains may be controlled by, if so required, employing a proper silver halide solvent.

The interior and/or surface of the silver halide grains employed in the silver halide emulsion layer of the invention are allowed to contain metallic ions, by employing following salts while the grains are formed and/or grown; a cadmium salt, zinc salt, lead salt, thallium salt, iridium salt or complex salt, rhodium salt or complex salt, and iron salt or complex salt. The interior and/or surface of the grains may endowed with reducing sensitization nuclei by placing the grains under an adequate reducing atmosphere.

Unnecessary soluble slats may be whichever removed from or remained in the silver halide emulsion of the invention after silver halide grains have satisfactorily grown. If the salts are to be removed, the removal can be exercised by following the method mentioned in Research Disclosure No. 17643.

The silver halide grains employed in a silver halide emulsion, according to the invention, may individually consist of whichever a uniform layer, or different interior and surface layers.

The silver halide grains employed in the silver halide emulsion of the invention may be the grains wherein a latent image is principally formed whichever on the surface thereof or in the interior thereof.

The silver halide grains employed in the silver halide emulsion of the invention may be the grains having whichever regular crystal forms or irregular crystal forms such as spherical or tabular. Among such grains, the proportion between {100}-faced and {111}-faced crystals may be arbitrarily selected. Additionally, such grains may have a epitaxial crystal configuration of the above mentioned crystal configurations, or consist of different type configurations.

More than two of separately prepared silver halide emulsions may be mixed and used as a silver halide emulsion of the invention.

A silver halide emulsion of the invention is chemically sensitized by conventional methods. Those methods are for example as follows: the sulfur sensitization method which employs sulfur compound which can react with silver ion, or employs activated gelatin; the selenium sensitization method which employs selenium; the reducing sensitization method which employs a reducing substance; the noble metal sensitization method which employs gold and other noble metal compounds. These methods may be independently or combinedly employed.

A silver halide emulsion of the invention can be optically sensitized to the desirable range of wavelength by employing a dye known as a sensitizing dye in the photographic art. The sensitizing dyes may be whichever independently or combinedly used. The emulsion may contain, in addition to the sensitizing dye, a dye which does not have a light-sensitization action in itself i.e. supersensitizer which actually absorbs no visible light and thereby enhancing sensitization action of a sensitizing dye.

For the purpose of preventing the fogging during manufacturing process and storage of light-sensitive material, and photographic treatment, and/or for the purpose of stabilizing photographic performance, into the silver halide emulsion of the invention may be added a compound, known as an anti-fogging agent or stabilizer in the photographic art, during chemical ripening process, and/or after the completion of chemical ripening and before the application of silver halide emulsion.

It is advantageous to use gelatin as a binder or, a protective colloid, of the silver halide emulsion of the invention. Other than gelatin, a gelatin derivative, graft polymer of gelatin and other high molecular polymer, protein, sugar derivative, cellulose derivative, or hydrophilic colloid such as a monopolymer or copolymer of a synthesized hydrophilic high molecular polymer may be used.

The photographic emulsion layers containing silver halide emulsion of the invention as well as other hydrophilic colloid layers may be hardened by independently or combinedly employing hardeners which form bridge between binder or, protective colloid, molecules so as to enhance the fastness of the layers. The amount of hardeners should be so much as to harden the light sensitive material and to the extent that the addition of hardener into processing solutions is not required, however, the addition of the hardener into the processing solutions is also allowable.

In order to improve the plasticity of the silver halide emulsion layers of the invention and/or other hydrophilic colloid layers, a plasticizer may be added to the similar layers.

In order to improve the dimension stability and other properties of the photographic emulsion layers of the light-sensitive materials of the invention involving silver halide emulsions of the invention and/or other hydrophilic colloid layers, an insoluble or slightly soluble synthesized polymer latex may be dispersed in the similar layers.

The emulsion layer of the silver halide color photographic light-sensitive material of the invention contains a dye forming coupler which is capable of forming a dye during the color developing process by coupling with an oxidation product of an aromatic primary amine developing agent such as a p-phenylenediamine derivative and aminophenol derivative.

Usually, a dye forming coupler is selected so that in each emulsion layer is formed a dye which absorbs a spectral range intended for the emulsion layer; a yellow dye forming coupler is incorporated into a blue-sensitive emulsion layer; a magenta coupler is incorporated into a green-sensitive emulsion layer; a cyan coupler is incorporated into a redsensitive emulsion layer. However, in compliance with a specific purpose, a silver halide color photographic material may be prepared by employing a combination other than those mentioned above.

The examples of a yellow dye forming coupler include an acylacetamine coupler, such as a benzoylacetanilide, and pivaloylacetanilide. The examples of a magenta dye forming coupler include the coupler of the invention, and a 5-pyrazolone coupler, pyrazolobenzimdazole coupler, pyrazolotriazole coupler, and open-chained acylacetonitrile coupler. The examples of a cyan dye forming coupler include a naphthol coupler, and phenol coupler. These dye forming couplers preferably have within the molecular structure a group called ballast group which has more than eight carbon atoms and capable of turning couplers non-diffusible. The dye forming coupler may be a tetravalent coupler which requires four silver ions to be reduced when forming a dye molecule; or a divalent coupler which requires two silver ions to be reduced when forming a dye molecule.

An anti-color fogging agent is employed, in order to prevent color impurity which is caused by the transfer of a oxidized product of a developing agent or an electrontransfer agent between emulsion layers (between the layers having an identical color sensitivity and/or between the layers having different color sensitivities to each other) of the color photographic light-sensitive material of the invention; or to prevent deterioration in sharpness and excessive graininess.

The anti-color fogging agent may be incorporated either into the emulsion layers themselves, or into intermediate layers provided between neighboring emulsion layers.

An image stabilizer to prevent the deterioration of dye-image may be incorporated into the light-sensitive material containing the silver halide emulsion of the invention.

A protective layer of the light-sensitive material or hydrophilic colloid layer such as intermediate layer of the invention, may contain an ultraviolet absorbent in order to prevent fogging caused by discharge from the light-sensitive material wherein the similar light-sensitive material has been triboelectrically electrified by friction or the like; or to prevent deterioration of an image caused by UV radiation.

A color light-sensitive material containing the silver halide emulsion of the invention may be provided with auxiliary layers such as a filter layer, anti-halation layer and/ or anti-irradiation layer and others. These layers and/or emulsion layers may contain a dye which may either flow out of a color light-sensitive material or may be bleached during the developing process.

In order to suppress a gloss of a light-sensitive material, to improve retouchability, to prevent mutual adhesion of light-sensitive materials, a matting agent may be added into silver halide emulsion layers of the silver halide light-sensitive material using the silver halide light-sensitive emulsion of the invention and/or the other hydrophilic colloid layers.

To reduce sliding friction of the light-sensitive material containing the silver halide emulsion of the invention, a lubricant may be incorporated.

In order to prevent electrification, an anti-static agent may be added into a light-sensitive material which uses the silver halide emulsion of the invention. The anti-static agent may be either added into an anti-static layer provided in one side of a support where no emulsion layer are provided, or into an emulsion layer and/or a protective colloid layer which is not an emulsion layer and is provided in the other side of the support where emulsion layers are to be disposed.

To improve the coating properties, to prevent electrification, to improve sliding properties, to enhance emulsification dispersion, to prevent mutual adhesion, and to improve photographic properties including acceleration of development, higher contrast, sensitization and others, various surface active agents are incorporated into the photographic emulsion layers of light-sensitive material containing the silver halide emulsion of the invention and/or other hydrophilic colloid layers.

The photographic emulsion layer of light-sensitive material having the silver halide emulsion of the invention as well as other layers may be disposed by applying emulsions to and drying over any of the following supports a flexible reflecting support made of a paper or synthesized paper provided with a lamination of a baryta layer or α-olefin polymer and the like; a film comprising a semi-synthesized or synthesized high molecule such as cellulose acetate, cellulose nitrate, polystyrene, polyvinyl chloride, polyethylene terephthalate, polycarbonate, polyamide and others; a rigid body such as glass, metal, ceramic and the like.

After the surface of support is subjected, in accordance with a specific requirement, to corona charge, ultraviolet-ray irradiation, flame treatment or the like, the silver halide emulsion of the invention may be applied to and dried over the similar surface directly, or via a subbing layer, one or more subbing layer is provided in order to improve, for the surface of support, such as the adhesion properties, anti-static properties, dimension stability, anti-abrasion properties, hardness, anti-halation properties, friction properties and/or other properties.

In the coating process of the photographic light-sensitive material containing the silver halide emulsion of the invention, a thickener may be used in order to improve the coating properties. As a coating method, either the extrusion coating or curtain coating, each being capable of simultaneously coating more than two layers, is especially advantageous.

The light sensitive material of the invention may be exposed with an electromagnetic wave having a spectral band to which the emulsion layers comprising the silver halide light sensitive material of the invention are sensitive. The known useful light sources are as follows: natural light (sunray), tungsten incandescent lamp, fluorescent lamp, mercury arc lamp, xenon arc lamp, carbon arc lamp, xenon flash lamp, cathode ray tube flying spot, various lasers, light emitting diodes, and light emitted from a fluorescent material excited by electron beam, X ray, gammer ray, alpha ray or the like.

As an exposure time, the duration ranges from one millisecond to one second, which is used for an ordinary camera. In addition, the exposure time with the duration less than one millisecond, 100 microsecond to 1 microsecond, for example, may be used by employing a cathode ray tube or xenon flash lamp. Furthermore, the exposure time may exceed one second. The exposure may be either continuously or intermittently carried out.

With the silver halide photographic light-sensitive material of the invention, the photographic image can be formed through the color developing known in the art.

The aromatic primary amine color developing agents incorporated into the color developer of the invention include the known agents widely used in various color photographic processes. Such developers include aminophenol and p-phenylenediamin derivatives. These compounds are principally used in the form of a salt such as a hydrochloride or sulfate, because they are stabler in the salt form than in the free form. Additionally, the similar compounds are usually used at a rate of approx. 0.1 to 30 g, or, more favorably approx. 1 to 15 g per liter color developer.

The examples of the aminophenol developers include an o-aminophenol, p-aminophenol, 5-amino-2-oxytoluene, 2-amino3-oxytoluene, 2-oxy-3-amino-1,4-dimethylbenzene and others.

The especially useful aromatic primary amine color developers are N,N'-dialkyl-p-phenylenediamine compounds, whose alkyl group and phenyl group may independently have a substituent. The examples of the especially useful such compounds include an N,N'-diethyl-p-phenylenediamine hydrochloride, N-methyl-p-phenylendiamine hydrochloride, N,N'-dimethyl-p-phenylenediamine hydrochloride, 2-amino-5-(N-ethyl-N-dodecylamino)-toluene, N-ethyl-N-β-methanesulfonamideetyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluensulfonate and others.

In addition to the above mentioned aromatic primary amine color developers, any compound which is component of the known developer may be added into the color developer used in the process according to the invention. The exmaples of such a compound which is arbitrary incorporated into the color developer are as follows: alkali agents such as sodium hydroxide, sodium carbonate, and potassium carbonate; sulfites of alkaline metals; bisulfites of alkaline metals; thiocyanates of alkaline metals; halides of alkaline metals; benzyl alcohol; water softener; thickener and others. The pH of the color developers are normally higher than 7, and, usually, approx. 10 to 13.

According to the invention, after the color developing, the light-sensitive material is further treated with a processing solution which has a fixing capability. If the processing solution having a fixing capability is a fixer, the bleaching process is exercised before the fixing. As a bleacher employed in the bleaching process, a metal complex salt of an organic acid is used. The metal complex salt oxidizes metal silver, which has been formed by development, into silver ion which in turn forms silver halide, and simultaneously develops a color in the non-colored portion of dye. The metal complex consists of an organic acid such as aminopolycarboxylic acid, oxalic acid, and citric acid, which coordinates with a metal ion such as of iron, cobalt, and copper. The exmaples of the most advantageous organic acid which forms such a metal complexes salt include polycarboxylic acid, and aminopolycarboxylic acid. Such a polycarboxylic acid or aminopolycarboxylic acid may be in the form of a salt of alkaline metal, ammonium salt, or water-soluble amine salt.

The typical examples of such a compound are as follows

[1]Ethylenediaminetetraacetic acid
[2]Nitrilotriacetic acid
[3]Iminodiacetic acid
[4]Disodium ethylenediaminetetraacetate
[5]Tetra (trimethylammonium) ethylenediaminetetraacetate
[6]Tetrasodium ethylenediaminetetraacetate
[7]Sodium nitrilotriacetate The employed bleaching agent may contain not only the previously mentioned complex metal salt of an organic acid as a beaching agent, but also various additives. The preferred examples of such additives are as follows: re-halogenating agents including an alkali halide and ammonium halide, such as potassium bromide, sodium bromide, sodium chloride, and ammonium bromide; a metal salt; and a chelating agent. Additionally, a pH buffering agent including borate, oxalate, acetate, carbonate, and phosphate; a compound which is known to be usually added to bleaching agent such as alkylamines, and polyethylenoxide may be arbitrary added to the bleaching agent in accordance with a requirement.

Furthermore, in compliance with a requirement, the fixer or the bleach-fixer may incorporate one or more pH buffering agents as follows: sulfites such as ammonium sulfite, potassium sulfite, ammonium bisulfite, potassium bisulfite, sodium bisulfite, ammonium metabisulfite, potassium metabisulfite, and sodium metabisulfite; boric acid; borax; sodium hydroxide; potassium hydroxide; various salts such as sodium carbonate, potassium carbonate, sodium bisulfite, sodium bicarbonate, and potassium bicarbonate; acetic acid; sodium acetate; and ammonium hydroxide When the bleach-fixer replenisher is added to the bleach-fixer (bath) during the continued process of the invention, the bleach-fixer (bath) may contain thiosulfate, thiocyanate, or bisulfite; or the bleach-fixer replenisher which contains such a salt may be added to the bleach-fixer.

With the present invention, in order to promote activity of the bleach-fixer, air or oxygen may be bubbled into bleach-fixer bath or the storage tank of the bleach-fixer replenisher; or an appropriate oxidizing agent such as hydrogen peroxide, bromate, persulfate may be added to the bleachfixer or bleach-fixer replenisher, if necessary.

EXAMPLE

The examples embodying the invention are hereinunder described. However, the scope of the exmaples of the invention is not limited only to them

Example 1

Compounds used to prepare samples

DNP: Dinonylphthalate

DOP: Dioctylphthalate

HQ-1

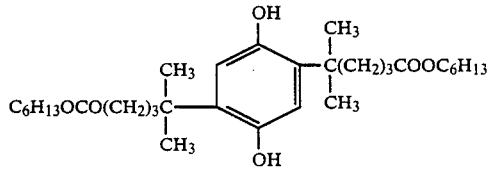

HQ-2

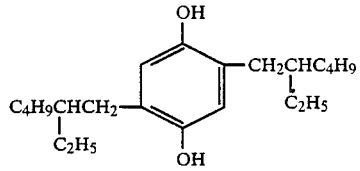

UV-1

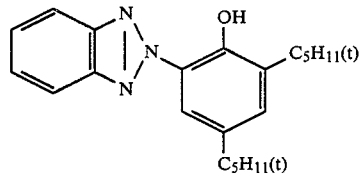

UV-2

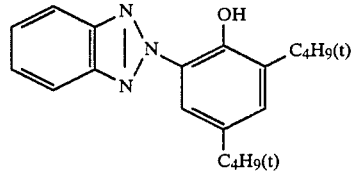

UV-3

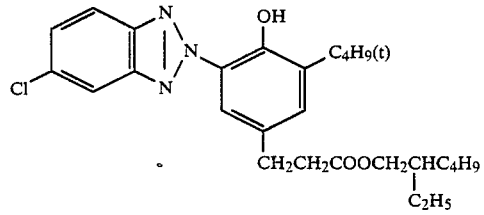

AO-1

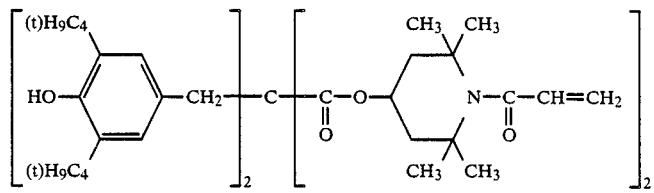

-continued

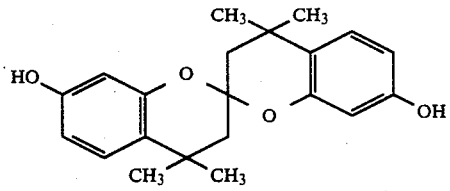

AO-2

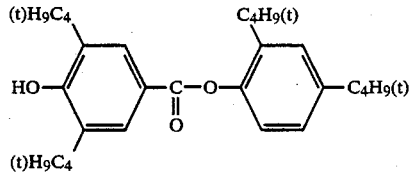

AO-3

Sample 1 having the following layer arrangement was prepared by coating a polyethylene-laminated paper support with the following layers in order from the support side.

Layer 1: A blue-sensitive emulsion layer

Comprising yellow coupler Y-1 of 8 mg/dm$^2$, a blue-sensitive silver chlorobromide emulsion containing silver chloride of 20 mol% and silver bromide of 80 mol% in an amount of 3 mg/dm$^2$ in terms of silver used, high boiling organic solvent DNP of 3 mg/dm$^2$, anti-discoloring agent AO-1 of 4 mg/dm$^2$ and gelatin of 16 mg/dm$^2$.

Layer 2: An interlayer

Comprising hydroquinone derivative HQ-1 of 0.45 mg/dm$^2$ and gelatin of 4 mg/dm$^2$.

Layer 3: A green-sensitive emulsion layer

Comprising magenta coupler M-1 of 4 mg/dm$^2$, a greensensitive silver chlorobromide emulsion containing silver chloride of 20 mol% and silver bromide of 80 mol% in an amount of 4 mg/dm$^2$ in terms of silver used, high boiling organic solvent DOP of 3.3 mg/dm$^2$, anti-discoloring agent AO-2 of 4 mg/dm$^2$ and gelatin of 16 mg/dm$^2$.

Layer 4: An interlayer

Comprising UV absorbents UV-1 of 3 mg/dm$^2$ and UV-2 of 3 mg/dm$^2$, high boiling organic solvent DOP of 4 mg/dm$^2$, hydroquinone derivative HQ-2 of 0.45 mg/dm$^2$ and gelatin of 14 mg/ dm$^2$.

Layer 5: A red-sensitive emulsion layer

Comprising cyan couplers C-1 of 2 mg/dm$^2$ and C-4 of 2 mg/dm$^2$, high boiling organic solvent DOP of 4 mg/dm$^2$, antidiscoloring agent AO-3 of 4 mg/dm$^2$, a red-sensitive silver chlorobromide emulsion containing silver chloride of 20 mol% and silver bromide of 80 mol% in an amount of 3 mg/dm$^2$ in terms of silver used, and gelatin of 14 mg/dm$^2$.

Layer 6: An interlayer

Comprising UV-absorbent UV-3 of 4 mg/dm$^2$, DOP of 2 mg/ dm$^2$ and gelatin of 6 mg/dm$^2$.

Layer 7: A protective layer

Comprising gelatin of 9 mg/dm$^2$.

The coating solution for the green-sensitive emulsion layer was prepared as follows: a total of 60 g of magenta coupler M-1, and 60 g of anti-fading agent (AO-2) were dissolved in a mixed solvent comprising 50 ml of dioctylphthalate and 200 ml of ethyl acetate. This solution was added to 1000 ml of 5% aqueous gelatin solution containing 5 g of sodium triisopropylnaphthalene sulfonate, and then, the mixture was homogenized using a homogenizer.

Then, 1500 ml of coating solution consisting of 3% aqueous gelatin solution containing 3 mg of sodium di-2-ethylhexylsufosuccinate as a coating aid, was added to the above mentioned dispersing solution of 1100 ml.

Additionally, 400 g of green-sensitive silver chlorobromide emulsion containing 60 g of silver, was added to the above mentioned solution to complete the preparation of the coating solution. A sample was prepared by applying and drying the coating solution so that the formed layer contained 4 mg/dm$^2$ of silver. The sample obtained by the procedure above was designated sample No. 1 (comparative).

Next, sample Nos. 2 through 18 were prepared, wherein the constitutions of those samples were identical with sample No. 1 except that the magenta coupler and the surface active agent for dispersing the magenta coupler were changed as listed in Table 1.

Using a photographic sensitometer (Model KS-7, Konica Corporation), each of these above mentioned samples was exposed to white light and green light through an optical wedge, and then treated with the following process Separately, each of these samples was stored for seven days at 55° C without humidification, and then treated with the same process.

| Processing steps | Processing temperature | Processing time |
|---|---|---|
| Color developing | 32.8° C. | 3 min. 30 sec. |
| Bleach-fixing | 32.8° C. | 1 min. 30 sec. |
| Washing | 32.8° C. | 3 min. 30 sec. |

| [Composition of color developer] | |
|---|---|
| N-ethyl-N-β-methanesulfonamideethyl-3-methyl-4-aminoaniline sulfate | 4.0 g |
| Hydroxylamine sulfate | 2.0 g |
| Potassium carbonate | 25.0 g |
| Sodium chloride | 0.1 g |
| Sodium bromide | 0.2 g |
| Sodium sulfite anhydride | 2.0 g |
| Benzyl alcohol | 10.0 ml |
| Polyethylene glycol (average polymerization degree, 400) | 3.0 ml |

Filled up to one liter with water. The pH level was adjusted to 10.0 using sodium hydroxide.

| [Composition of bleach-fixer] | |
|---|---|
| Sodium ferric ethylenediaminetetraacetate | 60.0 g |
| Sodium thiosulfate | 100.0 g |
| Sodium disulfite | 20.0 g |

-continued

| | |
|---|---|
| Sodium metabisulfite | 5.0 g |

Filled up one liter with water. The pH level was adjusted to 7.0 with sulfuric acid.

Green light reflecting density of neutral tone color images thus obtained was measured using an optical densitometer (Model PDA-65, Konica Corporation), whereby the gradation indicated by the toe portion of the resultant characteristic curve (highlight portion) was determined. As the gradation at the toe on each characteristic curve, the gradation values corresponding with the densities of 0.3 through 0.8 were measured.

In order to determine the color purity of magenta dye-formed sample, the spectral reflecting density was measured using the following procedure.

[Measurement of spectral reflecting density of magenta dye-formed sample]

Spectral reflection of the magenta dye formed portion in each sample was determined using a color analyzer Model 607 (Hitachi Ltd.). Spectral reflection was determined based on the maximum density of absorption spectrum of each sample in the visible range, that is, 1.0.

The reflection density of each sample at 420 nm was defined as the secondary absorption density and used as the standard in judging the color purity of each sample.

Table 1 lists the results.

As the results in Table 1 show, samples according to the invention provide improved color purity and less deterioration in gradation at the toe portion on characteristic curve even after a period of storage.

As for the neutral tone color forming property of samples after storage, when visually evaluating the low density portion of sample Nos. 1 through 4, red color was emphasized. On the other hand, in sample Nos. 5 through 16, neutral color was formed uniformly through high to low density portions, exhibiting good reproducibility of neutral tone color.

As to effect of a surface active agent according to the invention with respect to preventing deterioration attributable to storage, such effect was not observed in the samples using a comparative coupler. In comparative sample Nos. 17 and 18, the magenta dye image indicated much yellow stain, presenting an image lacking in satisfactory color reproducibility.

As mentioned above, only samples which combinedly using the magenta coupler of the invention and the surface active agent of the invention showed satisfactory reproducibility of both magenta dye image and neutral tone color image, whichever after or before storage of the sample.

Example 2

Sample Nos. 21 through 38 were prepared so that the constitution of each sample are identical with samples Nos. 1 through 19 employed in Example 1 except that silver chloro-bromide containing 99 mol% of silver chloride was used instead of the silver halide emulsion used in Example 1. Samples were exposed using the same procedure as in Example 1, then treated with the following developing process.

TABLE 1

| Sample No. | Magenta coupler | Surface active agent | Color purity (secondary absorption density) | Before storage (gradation at the toe on characteristic curve | After storage (gradation at the toe on characteristic curve) |
|---|---|---|---|---|---|
| 1 Comparative | M-1 | Comparative-1 | 0.205 | 1.85 | 1.61 |
| 2 Comparative | M-10 | Comparative-1 | 0.204 | 1.76 | 1.57 |
| 3 Comparative | M-25 | Comparative-1 | 0.205 | 1.74 | 1.43 |
| 4 Comparative | M-46 | Comparative-1 | 0.203 | 1.85 | 1.64 |
| 5 Invention | M-1 | 1 | 0.204 | 1.97 | 1.89 |
| 6 Invention | M-10 | 1 | 0.205 | 1.98 | 1.92 |
| 7 Invention | M-25 | 1 | 0.205 | 1.99 | 1.93 |
| 8 Invention | M-46 | 1 | 0.205 | 1.98 | 1.91 |
| 9 Invention | M-10 | 10 | 0.204 | 1.99 | 1.91 |
| 10 Invention | M-10 | 12 | 0.205 | 1.98 | 1.92 |
| 11 Invention | M-10 | 22 | 0.204 | 1.93 | 1.85 |
| 12 Invention | M-10 | 24 | 0.204 | 1.94 | 1.83 |
| 13 Invention | M-10 | 27 | 0.205 | 1.93 | 1.82 |
| 14 Invention | M-46 | 27 | 0.205 | 1.94 | 1.83 |
| 15 Invention | M-46 | 29 | 0.205 | 1.95 | 1.83 |
| 16 Invention | M-10 | 30 | 0.205 | 1.90 | 1.73 |
| 17 Comparative | Comparative-1 | Comparative-1 | 0.383 | 1.99 | 1.86 |
| 18 Comparative | Comparative-1 | 1 | 0.382 | 2.05 | 1.85 |

Comparative magenta coupler 1

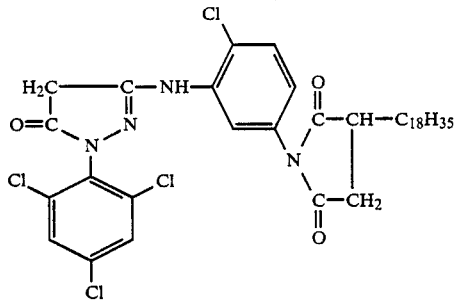

Comparative-1 (surface active agent): sodium triisopropylene naphthalenesulfonate

| | Temperature | Time |
|---|---|---|
| [Treatment process] | | |
| Color developing | 34.7 ± 0.3° C. | 50 sec. |
| Bleach-fixing | 34.7 ± 0.5° C. | 50 sec. |
| Stabilization | 30 to 40° C. | 90 sec. |
| Drying | 60 to 80° C. | 60 sec. |

[Color developer]

-continued

| | |
|---|---|
| Ethylene glycol | 10 ml |
| N,N'-diethylhydroxylamine | 10 ml |
| Potassium chloride | 2 g |
| N-ethyl-N-β-methanesulfonamideethyl-3-methyl-4-aminoaniline sulfate | 5 g |
| Sodium tetrapolyphosphonate | 2 g |
| Potassium carbonate | 30 g |
| Fluorescent whitening agent (derivative of 4,4'-diaminostylbenzsulfonic acid) | 1 g |

Filled up to one liter with pure water. The pH level was adjusted to 10.08.

| [Bleach-fixer] | |
|---|---|
| Ferric ammonium ethylenediaminetetraacetate dihydrate | 60 g |
| Ethylenediaminetetraacetic acid | 3 g |
| Ammonium thiosulfate (70% solution) | 100 ml |
| Ammonium sulfite (40% solution) | 27.5 ml |

The pH level was adjusted to 7.1 with potassium carbonate solution or glacial acetic acid. Then, filled up to one liter with water.

| [Stabilizer] | |
|---|---|
| 5-chloro-2-methyl-4-isotiazoline-3-one | 1 g |
| 1-hydroxyethylidene-1,1-diphosphonic acid | 2 g |

Filled up to one liter with water. The pH level was adjusted to 7.0 using sulfuric acid or potassium hydroxide solution.

Sample Nos. 25 through 36 according to the invention obtained by the procedure above presented vivid images with excellent color reproducibility of magenta image, and free from storage-induced deterioration in color reproducibility of neutral tone color images. Example 3

The following layers were sequentially disposed upon a subbed cellulose acetate film support in order to obtain coated samples. In this example, amounts of silver halide or colloidal silver are indicated as converted into the amounts of metal silver. Sample 4' Layer 1: Anti-halation layer Comprising 0.2 g/m$^2$ of black colloidal silver, and 1.7 g/m$^2$ of gelatin.

Layer thickness; 1.25 μm Layer 2: Intermediate layer

Comprising 1.0 g/m$^2$ of gelatin.

Layer thickness; 0.75 μm

Layer 3: Red-sensitive low-sensitivity silver halide emulsion layer

Comprising 1.6 g/m$^2$ core-shell type, average particle size, 0.5 μm, red-sensitive low-sensitivity silver bromo-iodide emulsion containing 10 mol% of oore and 2 mol% of shell, and having an average 5 mol% o±silver iodide: 1.7 g/ m$^2$ of gelatin; coupler C-11, described below, at a rate of 0.075 mol per one mole of silver; coupler CC-1 at a rate of 0.005 mol per mol silver; D-1, a DIR compound, described below, at a rate of 0.004 mol per mol silver.

Layer thickness; 2.75 μm

Layer 4: Red-sensitive high-sensitivity silver halide emulsion layer

Comprising 1.1 g/m$^2$ of red-sensitive low-sensitivity silver bromo-iodide emulsion, average particle size, 0.8 μm, containing 5.5 mol% of silver iodide; 1.0 g/m$^2$ of gelatin; coupler C-11, described below, at rate of 0.004 mol per mol silver; coupler C-12, described below, at a rate of 0.013 mol per mol silver; coupler CC-1 at a rate of 0.003 mol per mol silver; D-1, a DIR compound, at a rate of 0.002 mol per mol silver.

Thickness of layer; 1.2 μm Layer 5: Intermediate layer

Comprising 0.6 g/m$^2$ of gelatin.

Layer thickness; 0.45 μm

Layer 6: Green-sensitive low-sensitivity silver halide emulsion layer

Comprising 1.3 g/m$^2$ of core-shell type, average particle size, 0.5 μm, green-sensitive low-sensitivity silver bromoiodide emulsion containing 10 mol% of core and 2 mol% of shell, and having an average 5 mol% of silver iodide; 1.6 g/ m$^2$ of gelatin; coupler M-1, described below, at a rate of 0.055 mol per mol silver; coupler CM-1 at a rate of 0.014 mol per mol silver; D-2, a DIR compound described below, at a rate of 0.004 mol per mol silver.

Layer thickness; 2.7 μm.

Layer 7: Green-sensitive high-sensitivity silver halide emulsion layer

Comprising 1.0 g/m$^2$ of red-sensitive low-sensitivity silver bromo-iodide emulsion, average particle size, 0.8 μm, containing 5.5 mol% of silver iodide; 0.8 g/m$^2$ of gelatin; coupler M-1, described below, at a rate of 0.016 mol per mol silver; coupler CM-1, described below, at a rate of 0.005 mol per mol silver; D-2, a DIR compound described below, at a rate of 0.002 mol per mol silver.

Layer 8: Intermediate layer

Comprising 0.6 g/m$^2$ of gelatin.

Layer thickness; 0.45 μm.

Layer 9: Yellow filter layer

Comprising 0.1 g/m$^2$ of yellow colloidal silver; 0.7 g/m$^2$ of gelatin; and 0.006 g/m$^2$ of anti-stain agent HQ-3. HQ-3 was added as an emulsified dispersed material.

Layer thickness; 0.6 μm.

Layer 10: Blue-sensitive low-sensitivity silver halide emulsion layer

Comprising 0.5 g/m$^2$ core-shell type (average particle size, 0.5 μm) blue-sensitive low-sensitivity silver bromo-iodide emulsion containing 10 mol% of core and 2 mol% of shell, and having an average 5 mol% of silver iodide; 2.0 g/ m$^2$ of gelatin; coupler Y-16, described below, at a rate of 0.34 mol per mol silver.

Layer thickness; 3.1 μm.

Layer 11: Blue-sensitive high-sensitivity silver halide emulsion layer

Comprising 0.5 g/m$^2$ blue-sensitive low-sensitivity silver bromo-iodide emulsion (average particle size, 0.8 μm) containing 7 mol% of silver iodide; 1.2 g/m$^2$ of gelatin; coupler Y-16, described below, at a rate of 0.10 mol per mol silver.

Layer thickness; 1.4 μm.

Layer 12: Protective colloid layer

Comprising 2.0 g/m$^2$ of gelatin.

Layer thickness; 1.5 μm. The following materials were used to prepare the samples.

Coupler CC-1
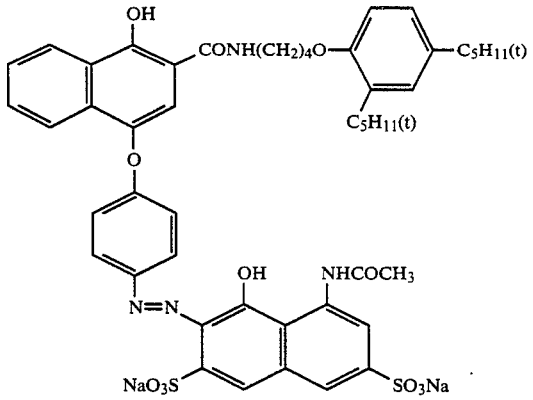
Coupler CM-1
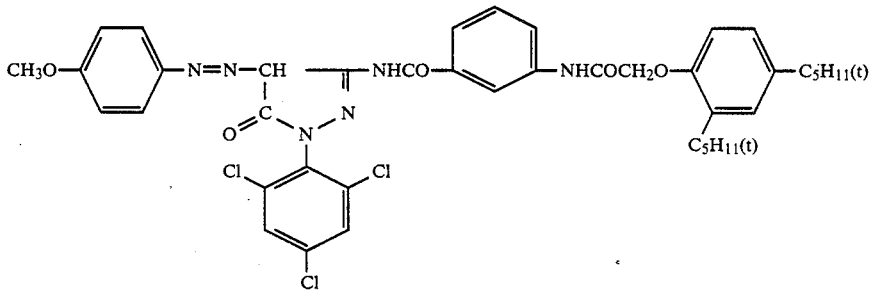
HQ-3
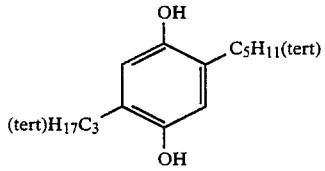
Coupler C-11
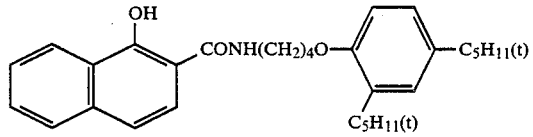
Coupler C-12
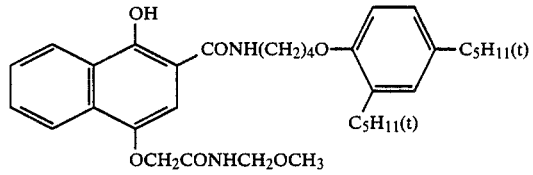
M-1
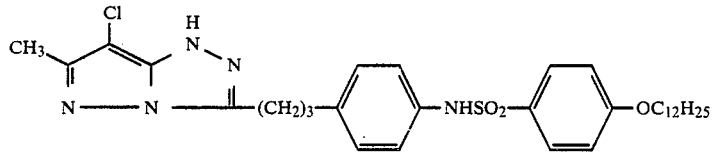

-continued

Coupler Y-16

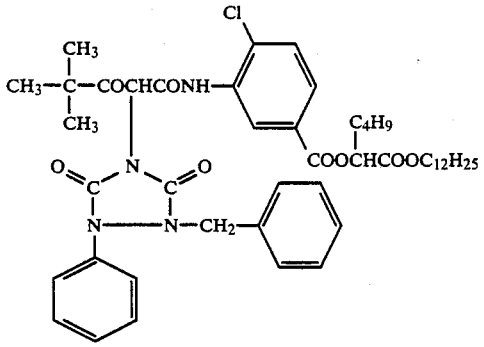

DIR compound D-1

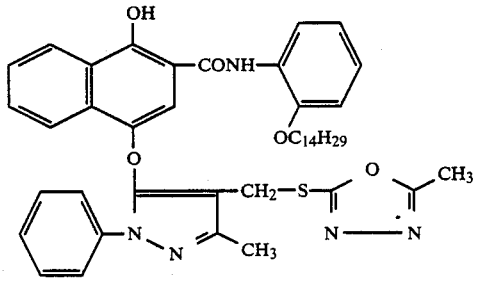

DIR compound D-2

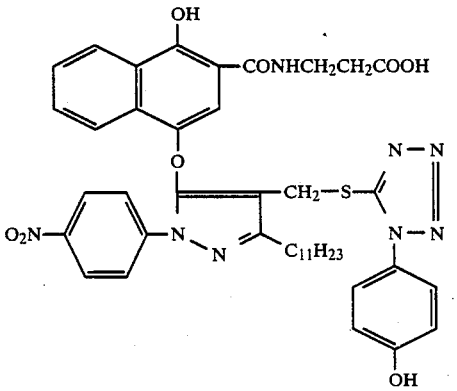

As a dispersion auxiliary, sodium di-ethylhexylsulfosuccinate was added to the green-sensitive high-sensitivity silver halide emulsion (layer 7). The sample thus obtained was designated sample No. 41.

Next, sample No. 42 was prepared, which was identical with sample No. 41 except that sample No. 42 contained the surface active agent-1 according to the invention as a dispersion auxiliary of the green-sensitive high-sensitivity silver halide emulsion layer in sample No. 41.

Each test piece (3.5 cm×14 cm) of sample Nos. 37 and 38 was tightly attached to an independent transparent square-waveform chart, and exposed to white light and green light. Then, samples bearing dye images were obtained by treating these test pieces with the following process.

| Developing process (38° C.) | Processing time |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |

Compositions of the processing solutions employed in the respective processes were as follows

| [Composition of color developer solution] | |
|---|---|
| 4-amino-3-methyl-N-ethyl-N-(β-hydroxyethyl)-aniline sulfate | 4.75 g |
| Sodium sulfite anhydride | 4.25 g |
| Hydroxylamine ½ sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |

Filled up to one liter with water. The pH level was adjusted to 10.0.

| [Composition of bleacher solution] | |
|---|---|
| Ferric ammonium ehtylenediaminetetraacetate | 100.0 g |
| Ethylenediaminetetraacetic diammonium | 10.0 g |
| Ammonium bromide | 150.0 g |
| Glacial acetic acid | 10.0 g |

Filled up to one liter. The pH level was adjusted to 6.0.

| [Composition of fixer solution] | |
|---|---|
| Ammonium thiosulfate (50% aqueous solution) | 162 ml |
| Sodium sulfite anhydride | 12.4 ml |

Filled up to one liter with water. The pH level was adjusted to 6.5.

| [Composition of stabilizer solution] | |
|---|---|
| Formalin (37% aqueous solution) | 5.0 ml |
| Konidax (Konica Corporation) | 7.5 ml |
| Filled up to one liter with water. | |

Filled up to one liter with water.

Compared with sample No. 41, sample No. 42 presented a negative image having satisfactory color reproducibility of magenta image, and was free from storage-induced deterioration in neutral tone color reproducibility.

As stated above, combinedly employed a magenta coupler expressed by general formula M-1 according to the invention and a specific surface active agent ensures excellent color reproduction and image preservability, wherein a raw sample is provided with improved preservability; in particular, softening indicated by the toe portion on the resultant characteristic curve is satisfactorily suppressed, whereby a color image with good color balance is obtainable.

What is claimed is:

1. A silver halide photographic light-sensitive material comprising a support having thereon at least one silver halide emulsion layer, wherein said silver halide photographic light-sensitive material contains a magenta coupler represented by the Formula M-1

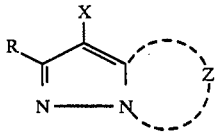

Formula M-1 wherein Z represents a group of non-metal atoms necessary for forming a nitrogen-containing heterocyclic which may have a substituent group; X represents a hydrogen atom, or a group capable of being split off upon the reaction with the oxidized product of a color developing agent; and R represents a hydrogen atom or a substituent; and at least one surface active agent having in the molecule thereof at least two groups selected from the group consisting of a carboxy group and salts thereof, a sulfonic group and salts thereof, and a salt of a sulfuric ester group.

2. The material of claim 1, wherein said surface active agent has a carboxy group or a salt thereof, and a sulfonic group or a salt thereof in its molecule.

3. The material of claim 1, wherein said surface active agent is represented by the following Formulas I, II or III:

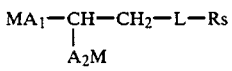

Formula I

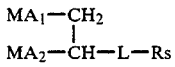

Formula II

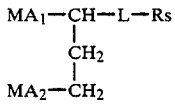

Formula III wherein Rs represents a substituent; L represents a —COO— group or —CONH— group; $A_1$ and $A_2$ represent a $—COO^{\ominus}$, $—SO_3^{\ominus}$or $—OSO_3^{\ominus}$, respectively; and M represents a hydrogen atom or a cation.

4. The material of claim 3, wherein said surface active agent is represented by the following formula I', II', II'' or III':

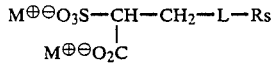

Formula I'

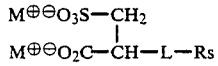

Formula II'

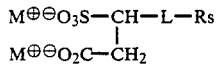

Formula II''

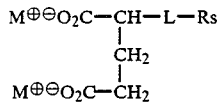

Formula III' wherein M, L and Rs are the same as M, L and Rs in the formula I, respectively.

5. The material of claim 4, wherein said surface active agent is represented by the formula I', II'or II''.

6. The material of claim 1, wherein said surface active agent is contained in s id material in an amount of 0.001 g to 0.1 g per gram of said magenta coupler.

7. The material of claim 6, wherein said amount of said surface active agent is 0.01 g to 0.05 g per gram of said magenta coupler.

* * * * *